US007264033B2

(12) United States Patent
Lai

(10) Patent No.: US 7,264,033 B2
(45) Date of Patent: Sep. 4, 2007

(54) MULTI-FUNCTIONAL SHADING DEVICE

(76) Inventor: Tony Lai, 2185 Victoria Way, Rowland Heights, CA (US) 91748

( * ) Notice: Subject to any disclaimer, the term of this patent is extended or adjusted under 35 U.S.C. 154(b) by 384 days.

(21) Appl. No.: 10/837,380

(22) Filed: Apr. 30, 2004

(65) Prior Publication Data

US 2005/0006035 A1 Jan. 13, 2005

Related U.S. Application Data

(60) Continuation-in-part of application No. 10/237,236, filed on Sep. 9, 2002, now Pat. No. 6,854,502, which is a division of application No. 09/810,814, filed on Mar. 16, 2001, now Pat. No. 6,516,856.

(51) Int. Cl.
*E06B 3/32* (2006.01)

(52) U.S. Cl. ..... 160/89; 160/84.03; 160/172 R

(58) Field of Classification Search ..... 160/172 R, 160/84.06, 31, 271, 272, 270, 167 R, 84.03, 160/115

See application file for complete search history.

(56) References Cited

U.S. PATENT DOCUMENTS

| | | | | | |
|---|---|---|---|---|---|
| 2,389,956 | A * | 11/1945 | Castilonia | ..... | 160/172 R |
| 3,192,991 | A * | 7/1965 | Anderle | ..... | 160/167 R |
| 4,341,254 | A * | 7/1982 | Schaller et al. | ..... | 160/172 R |
| 4,799,524 | A * | 1/1989 | Guermonprez | ..... | 160/84.03 |
| 4,813,468 | A * | 3/1989 | Fraser | ..... | 160/84.03 |
| 4,953,610 | A * | 9/1990 | Phillips et al. | ..... | 160/84.03 |
| 5,121,783 | A * | 6/1992 | Nilsson | ..... | 160/89 |
| 5,379,823 | A * | 1/1995 | Kraeutler | ..... | 160/271 |
| 5,791,390 | A * | 8/1998 | Watanabe | ..... | 160/84.03 |
| 6,085,823 | A * | 7/2000 | Oskam | ..... | 160/172 R |
| 6,276,425 | B1 * | 8/2001 | Mausar et al. | ..... | 160/84.03 |
| 6,516,856 | B2 * | 2/2003 | Lai | ..... | 160/89 |
| 6,688,372 | B1 * | 2/2004 | Nien | ..... | 160/172 R |
| 6,814,128 | B2 * | 11/2004 | Nien | ..... | 160/84.06 |
| 6,854,502 | B2 * | 2/2005 | Lai | ..... | 160/89 |
| 7,028,737 | B2 * | 4/2006 | Hsu | ..... | 160/84.03 |

* cited by examiner

*Primary Examiner*—David Purol
(74) *Attorney, Agent, or Firm*—Raymond Y. Chan; David and Raymond Patent Group

(57) ABSTRACT

A multi-functional shading device includes a first shading arrangement including a top traverse supporter adapted for affixing to a top beam of a ceiling, a first shading arrangement downwardly extended from the top traverse supporter including a base member and a first operating means for selectively lifting up the base member towards the traverse supporter and unlifting the base member to drop downwardly away from the traverse supporter, a second shading arrangement including a base stabilizer, a translucent fabric, which is folded in a Z-shaped manner, downwardly extended from the base member to the base stabilizer, a second operating means for folding and unfolding the translucent fabric, and a pair of windproof arms disposed on two sides of shading arrangements for restricting shading device from swaying back and forth. Therefore, the first and second shading arrangements having different light intensity blooding abilities are adapted for selectively blocking lights passing through from one side to another side of the shading arrangements respectively.

7 Claims, 22 Drawing Sheets

MULTI-FUNCTIONAL SHADING DEVICE

CROSS REFERENCE OF RELATED APPLICATION

This is a continuation in part application of a non-provisional application number 10//237,236, filed Sep. 09, 2002, now U.S. Pat. No. 6,854,502, which is a divisional application of a non-provisional application number 09/810,814, filed on Mar. 16, 2001, now U.S. Pat. No. 6,516,856.

BACKGROUND OF THE PRESENT INVENTION

1. Field of Invention

The present invention relates to window curtains, and more particularly to a multi-functional shading device which is adapted for selectively shading the intensity of sunlight.

2. Description of Related Arts

Curtains and the like such as drapes and portieres are commonly used for sheltering window, separating spaces, and etc since they are easy to open and close, and aesthetically appealing. Most of the curtains comprise a traverse supporter adapted to be affixed to a ceiling, a slider track mounted on a bottom of the traverse supporter, and a plurality of slates horizontally and suspendedly mounted by hanging strings respectively in such a manner by operating a pulley system, the slats are slid in a vertical movable manner, or individually rotated at the same time.

However, the curtain has several drawbacks. When the curtain is opened, the house will be exposed directly to an excessive amount of sunlight which not only can heat up interior air of the house but also unpleased people's eye. On the other hand, when the curtain is fully closed, sunlight will be definitely blocked. So, people in the house, with no options, have to turn on the light lamp to brighten up the house. Furthermore, people has not privacy at all since when the curtain is fully opened, the inside scenery of the house is easily viewed from outside so that people may either close the curtain for privacy and security or open the curtain to enjoy the sunlight.

Therefore, draperies, an alternative method for blocking the sunlight, have been used for translucent window curtain. The drapery, usually made of lightweight woven, could provide decorative effects and satisfied privacy for people because the drapery is semi-transparent that people from outside can not view the interior scenery through the translucent window. Moreover, the drapery can partially block the sunlight so as to soften the sunlight.

However, the above mentioned blinding devices, such as curtains and drapery, are not adapted to be used under a strong windy circumstance. Since there are no wind-proof functions embodied, the strong wind would cause curtains and draperies sway back and forth with an annoying noise. Even worse, the swaying blinding devices sometimes would hit the objects positioned close to the window. Especially, drapery is soft and lightweight, so the wind can easily blow it to sway creating undesirable light effects and even an embarrassing "flying" drapery.

SUMMARY OF THE PRESENT INVENTION

A main object of the present invention is to provide a multi-functional shading device, which comprises a blind section and translucent fabric section so as to selectively shade the intensity of sunlight.

Another object of the present invention is to provide a multi-functional shading device, wherein the blind section and translucent fabric section are operating individually so as to prevent the sections from being interfered with each other.

Another object of the present invention is to provide a multi-functional shading device which is facilitated to be installed to a ceiling.

Another object of the present invention is to provide a multi-functional shading device which is wind-proof.

Another object of the present invention is to provide a multi-functional shading device which can achieve all features of conventional curtains such as easy operation, less expensive, adapted to soften the sunlight, keep personal privacy, and providing an aesthetically appealing. In other words, the present invention is an all-in window curtain.

Accordingly, in order to accomplish the above objects, the present invention provides a multi-functional shading device, which comprises:

a top traverse supporter adapted for affixing to a top beam of a ceiling;

a first shading arrangement downwardly extended from the top traverse supporter comprising a base member and a first operating means for selectively lifting up the base member towards the traverse supporter and unlifting the base member to drop downwardly away from the traverse supporter;

a second shading arrangement comprising a base stabilizer, a translucent fabric, which is folded in a Z-shaped manner, downwardly extended from the base member of the first shading arrangement to the base stabilizer, and a second operating means for folding and unfolding the translucent fabric, wherein the first and second shading arrangements having different light intensity blocking abilities are adapted for selectively blocking lights passing through from one side to another side of the shading arrangements respectively; and a wind-proof arrangement, which comprises:

a pair of wind-proof guiding devices, downwardly extended from two side portions of the top transverse supporter toward the base stabilizer of the second shading arrangement for substantially restricting the first shading arrangement and the second arrangement from swaying in the wind.

These and other objectives, features, and advantages of the present invention will become apparent from the following detailed description, the accompanying drawings, and the appended claims.

DETAILED DESCRIPTION OF THE PREFERRED EMBODIMENT

Figure 1:
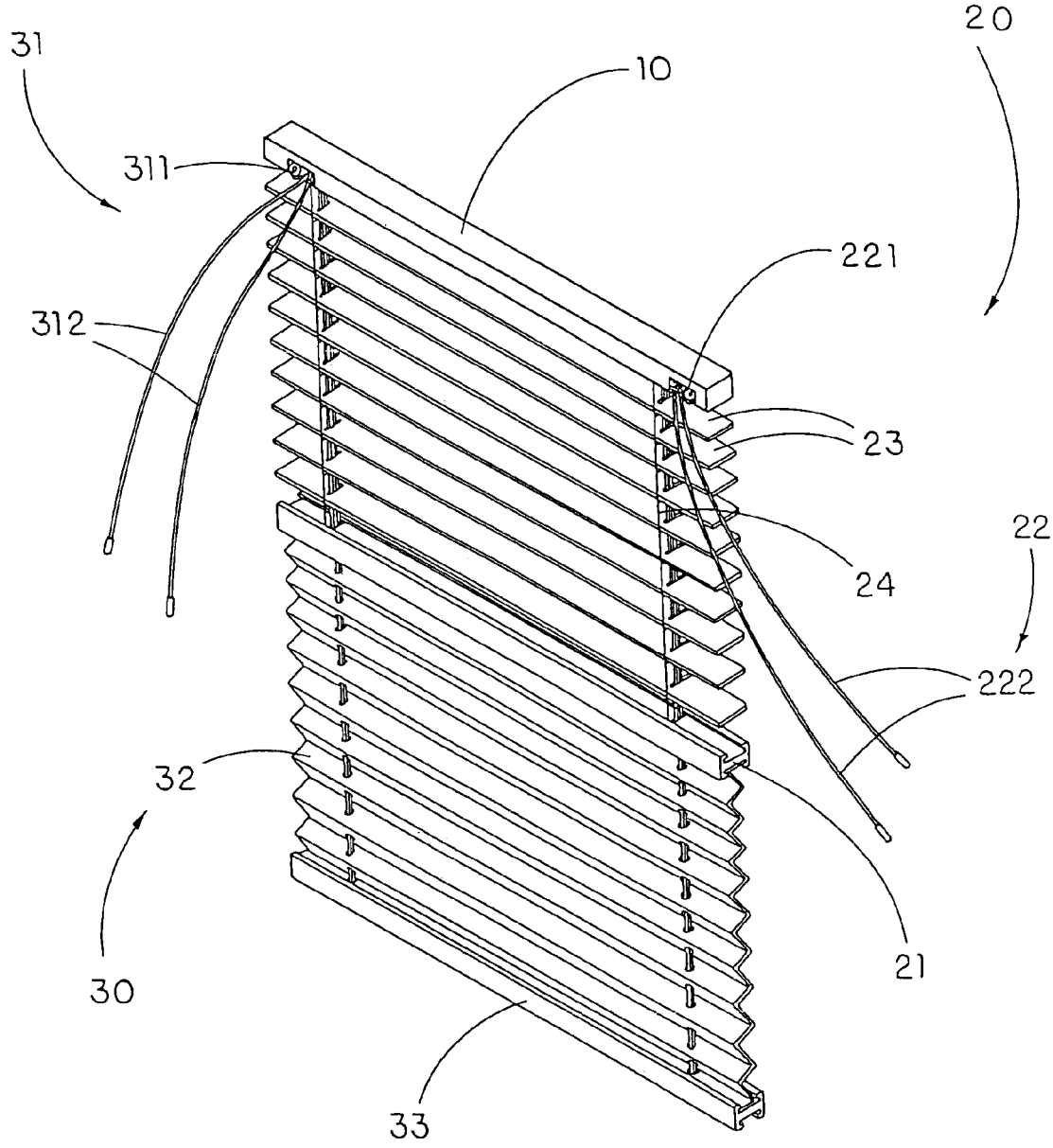
FIG. 1 is a perspective view of a multi-functional shading device according to a first preferred embodiment of the present invention.

Referring to FIG. 1 of the drawings, a multi-functional shading device according to the preferred embodiment of the present invention is illustrated, wherein the multi-functional shading device is adapted for mounting on a window frame so as to selectively blocking the sunlight from outside.

The multi-functional shading device comprises a top traverse supporter 10 adapted for affixing to a top beam C of a window, a first shading arrangement 20, and a second arrangement 30 wherein the first shading arrangement 20 and the second shading arrangement 30 having different light intensity blocking abilities are adapted for selectively blocking the light passing through form one side to another side of the multi-functional shading device.

The first shading arrangement 20 is downwardly extended from the top traverse supporter 10 wherein the first shading arrangement 20 comprises a base member 21 provided at a bottom portion thereof and a first operating means 22 for selectively lifting up the base member 21 towards the traverse supporter 10 and unlifting the base member 21 to drop downwardly away from the traverse supporter 10.

The first shading arrangement 20 preferably is a slat-type curtain, which comprises a plurality of slats 23, and a blind supporting system 24 for spacedly and suspendedly supporting the slats 23 horizontally between the traverse supporter 10 and the base member 21 and controlling a tilt angle of each of the slats 23.

Figure 2:
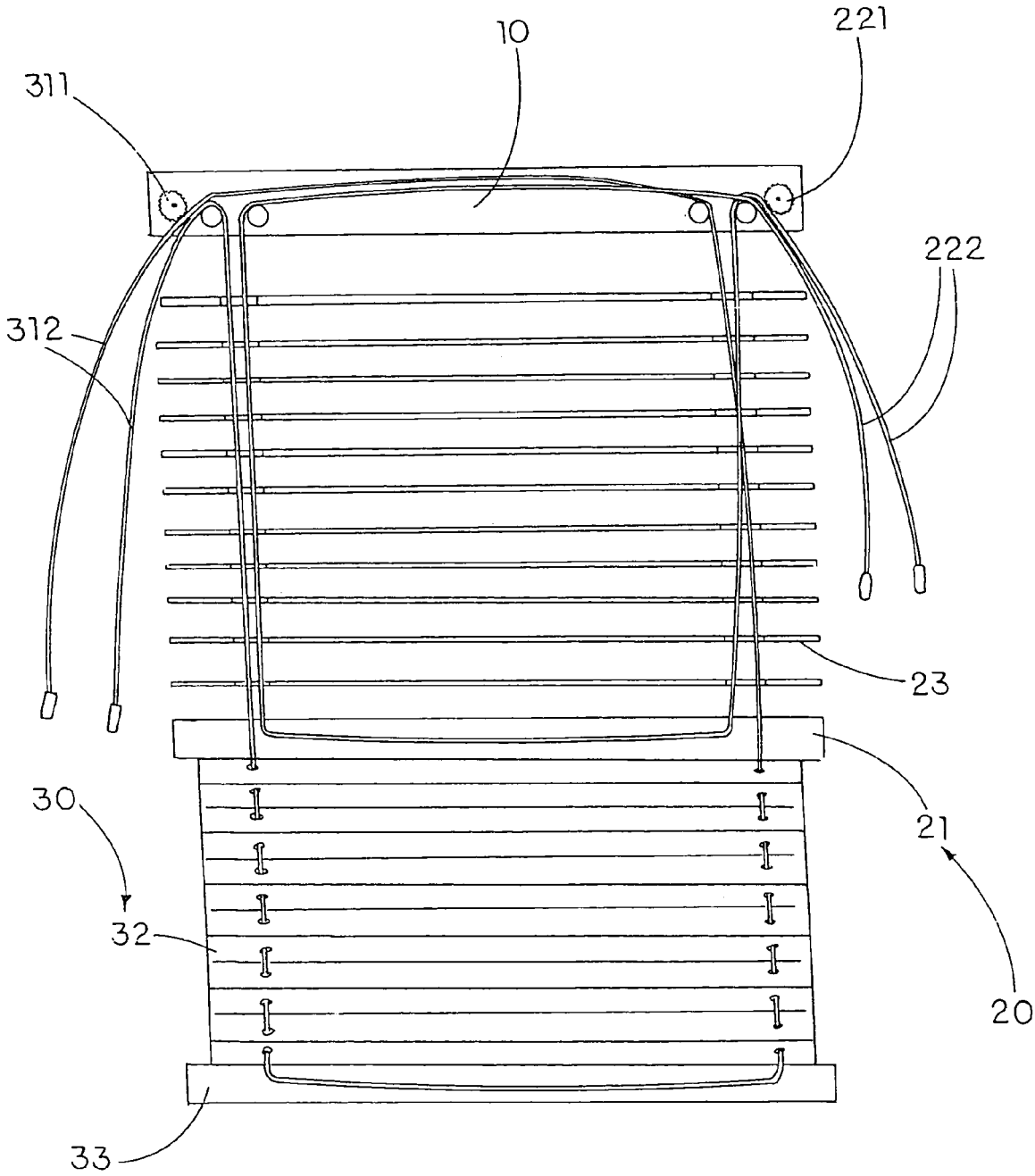
FIG. 2 is a schematic view of the multi-functional shading device according to the first preferred embodiment of the present invention.

The first operating means 22 comprises a first lift lock 221 rotatably mounted on the traverse supporter 10 and a pair of lift cords 222 each having a first end portion extended to the bottom member 21. Each of the two lift cords 222 upwardly extends to penetrate through the slats 23 and then traversely extends through the traverse supporter 10, wherein a second end portion of each of the lift cords 222 is extended out of the traverse supporter 10 via the first lift lock 221 to control the folding and unfolding of the first shading arrangement 20. Accordingly, the lift cords 221 can be integrally connected together along the base member 21 so as to enhance the folding and unfolding operations of the shading arrangement 20, as shown in FIG. 2.

The second shading arrangement 30, which is disposed beneath the first shading arrangement, is downwardly extended from the base member 21 of the first shading arrangement 20. According to the first preferred embodiment of the present invention, the second shading arrangement comprises a second operating means 31 for folding and unfolding the second shading arrangement 30, which further comprises an upper supporter 34, a base stabilizer 33 and a translucent fabric 32, being folded in a Z-shaped manner, extended vertically between the upper supporter 31 and the base stabilizer 33.

Here, the translucent fabric 32 is preferably made of woven which is adapted for partially blocking the light so as to soften the light. The base stabilizer 33 is adapted for providing a weight of the translucent fabric 32. Since the translucent fabric 33 is soft and light weight, the wind can cause it to sway which may create disturbing light effects and even has an embarrassment of "flying" fabric. So, the base stabilizer 33 is adapted for reinforcing the shape of the translucent fabric 33 so as to enhance the folding operation of the second shading arrangement 30. However, a flat translucent fabric 32 is still not suitable for being used in a strong windy circumstance. This is due to the fact that even the base stabilizer 33 could provide a weight to restrain the swaying, the middle portion of the translucent fabric 32 will be blow into a protruded shape which causes an unsightly appearance. According to the present invention, the Z-shaped folded translucent 32 is born to solve this problem.

Meanwhile, the upper supporter 34 is adapted for hanging the second shading arrangement as well as for attaching said second shading arrangement 30 on the first shading arrangement 20 to enable different light blocking capabilities.

Referring to FIG. 2, the second operating means 31 comprises a second lift lock 311 rotatably mounted on the traverse supporter 10 and a pair of lift cords 312 upwardly extending to traversely extending through the traverse supporter 10. Each of the lift cords 312 has a first end portion extended to the base stabilizer 33 and a second end portion extended out of the traverse supporter 10 via the second lift lock 311 for lifting up the base stabilizer 33 towards the top stabilizer 31 and unlifting the base stabilizer 33 to drop downwardly away from the top stabilizer 31, so as to fold and unfold the translucent fabric 32 respectively. Accordingly, the lift cords 312 are integrally connected together along the base stabilizer 33 so as to enhance the folding and unfolding operations of the second shading arrangement 30.

It is worth to mention that the first shading arrangement 20 and the second arrangement 30 could be independently operated. In other words, the first shading arrangement 20 and the second shading arrangement 30 could de detached and two shading arrangement could be put into application individually. Since most shading devices available on market nowadays are of slat types, the present invention also provides an effective second shading arrangement 30, which is made of woven translucent materials, for incorporating with the first shading arrangement 20 to broaden the light blocking options. As a result, users could attach this kind of second shading arrangement 30 on the preexisted traditional slat types shading arrangement to achieve a combined blocking effect.

Figure 3:
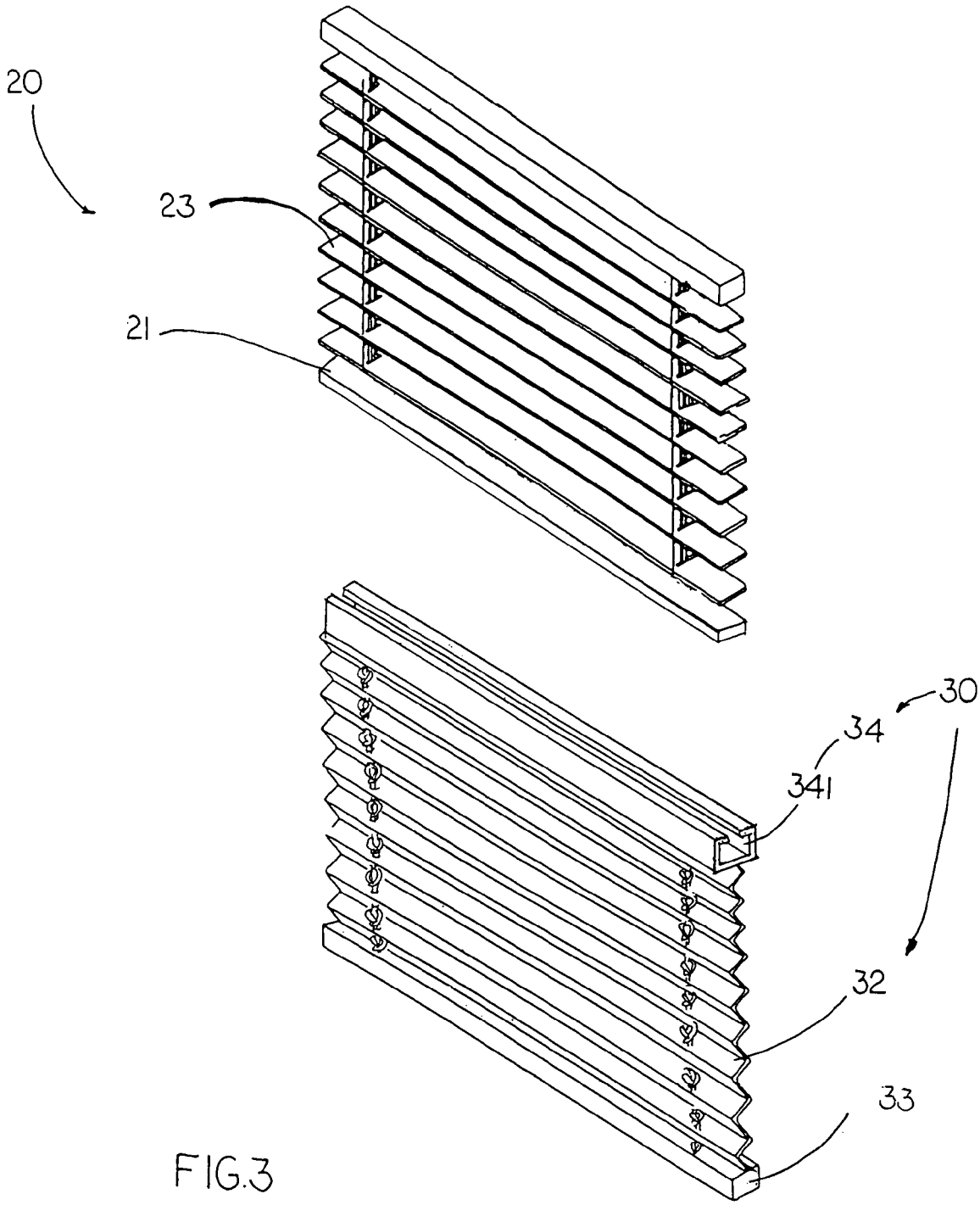
FIG. 3 is perspective view of the multi-functional shading device illustrating the second shading arrangement is independently operated and adapted to be attached on the first shading arrangement.

Referring to the FIG. 3, the multifunctional shading device further comprises at least a mounting means 40 for selectively and securely connecting the second shading arrangement 30 with the first shading arrangement 20. By attaching the upper supporter 34 of the second shading arrangement 30 on the base member 21 of the first shading arrangement 20, users could simply dispose the translucent shading arrangement 30 to a position beneath the slat type shading arrangement 20.

According to the first preferred embodiment of the present invention, the upper supporter 34 is functioned as the mounting means 40 having an upper mounting member 341 adapted for attaching on the base member 21 of the first shading arrangement.

As shown in FIG. 3, the top mounting member 341 is U-shaped formed for securely receiving the base member 21 of said first shading arrangement 20, and the top mounting member 341 further comprise a base portion adapted for holding the translucent fabric 32, so that the mounting means 40 is viewed as a U-shaped connecting member having a top mounting slot wherein the base member 21 of said first shading arrangement 20 is slidably inserted into said top mounting slot and said upper supporter 34 of said second shading arrangement 30 is integrally formed with the base portion so as to securely connect said second shading arrangement 30 to said first shading arrangement 20.

Alternatively, it is noted that the mounting means 40 could have a top mounting member 41 and the bottom mounting member 42, which are capable of being firmly and detachably engaged to form a loop for encircling said base member 21 and said upper supporter 34 together thereby selectively and detachably combing said first shading arrangement 20 and said second shading arrangement 30. This is to say, the top mounting member 41 is functioned as a male engaging member, while the bottom mounting member 42 is functioned as a female member as well for being engaged with the top mounting member 41 to form a loop for encircling the upper supporter 34 with the base member 21 or base stabilizer 33 as shown in FIG. 3B.

Therefore, by detaching or attaching the mounting means 40, the user would be able to selectively connect the second shading arrangement 30 with the first shading arrangement 20 simply and conveniently. If the user just intends to fold the translucent fabric shading arrangement in a minimum manner, he or she merely attaches the upper supporter 34 with the base stabilizer 31 together.

Here, the mounting means 40 could be embodied as traditional engaging means, like loop and hook fastener under the register name "Velcro", buckle, clippers, buttons, and the like. It is noted that the mounting means 40 could be an independent fastening member too, like a rubber band, a knitted rope, etc.

Figure 3B:
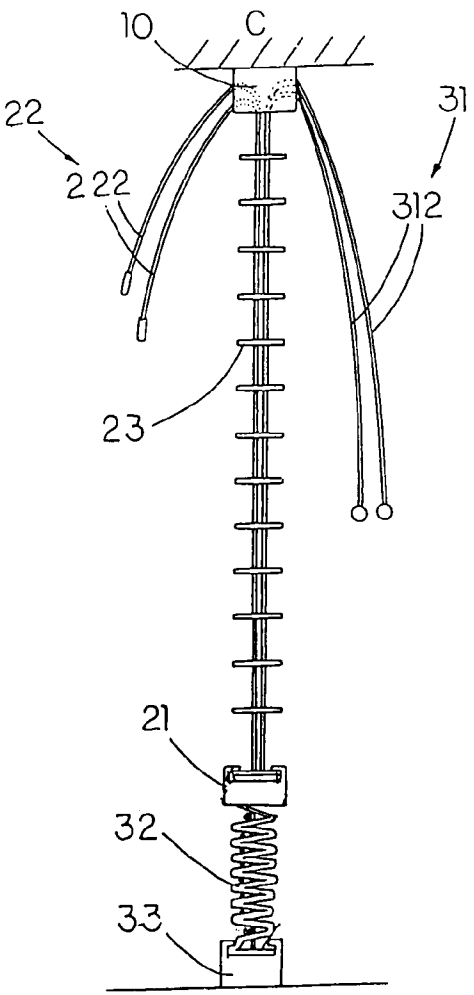
FIG. 3A to 3D illustrates an operation of the multi-functional shading device according to the above first preferred embodiment of the present invention.
Figure 3A:
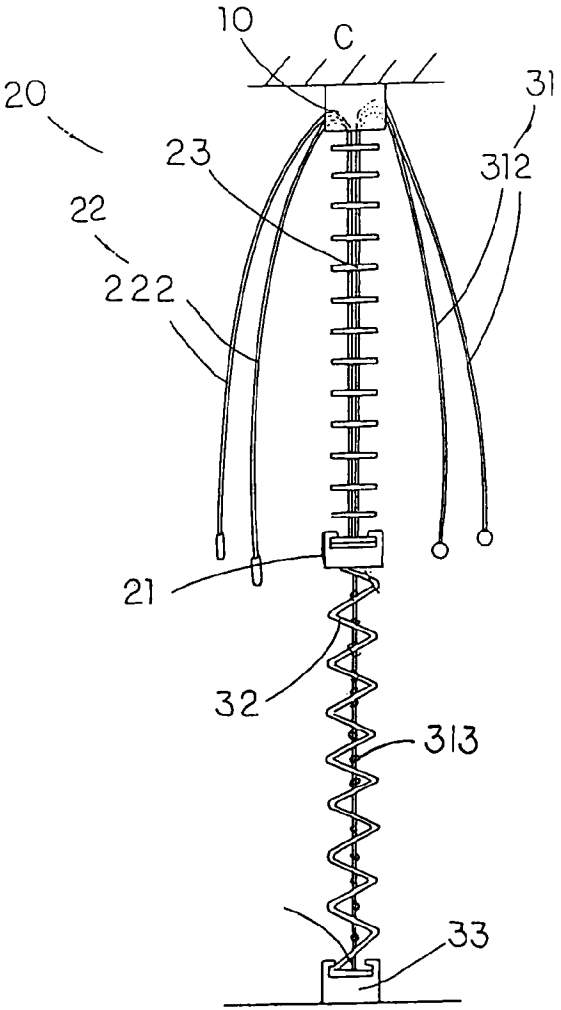
Figure 3C:
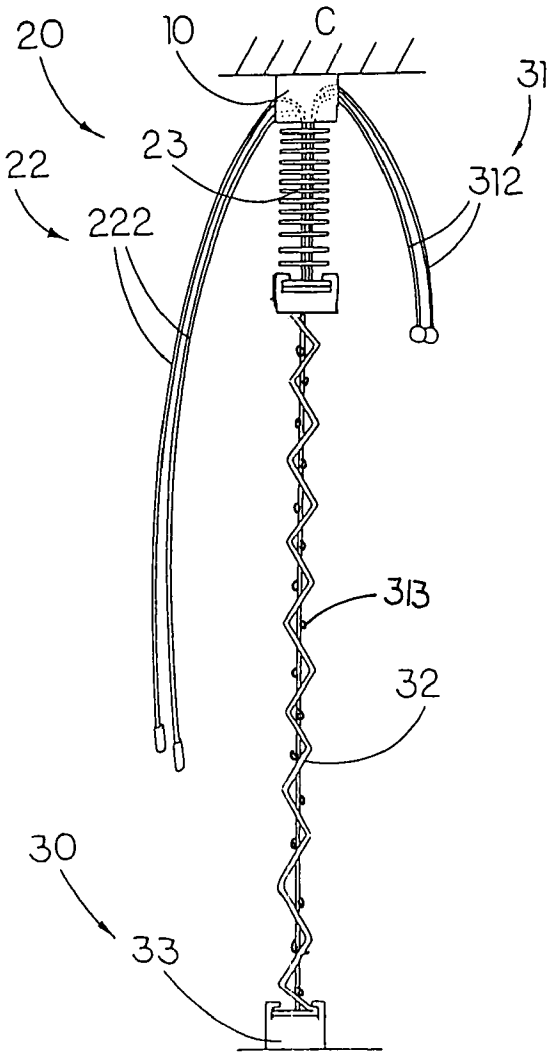
Figure 3D:
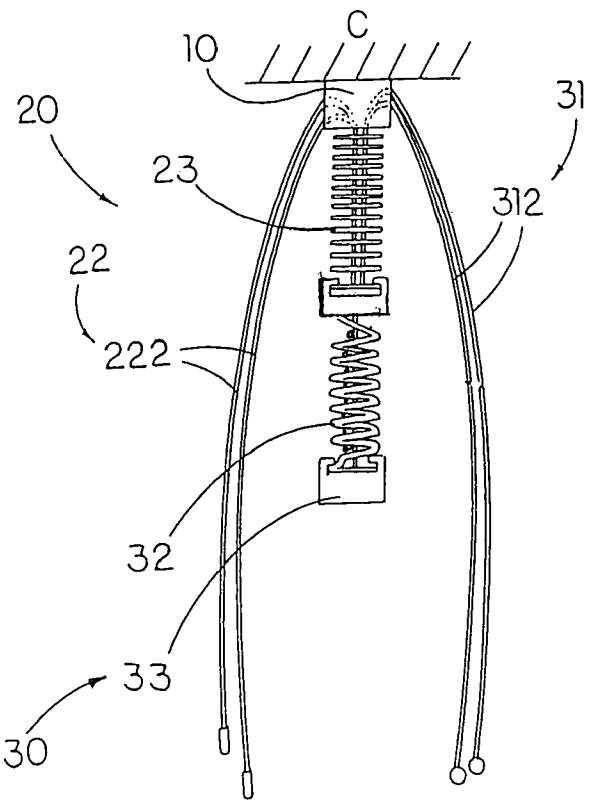

As shown in FIGS. 3A through 3D, the multi-functional shading device is capable of providing various shading areas for the user. As shown in FIG. 3A, the first and second shading arrangement 20, 30 are partially unfolded in such a manner that the light from outside is partially divided into an upper portion and a lower portion wherein the upper portion of the light is selectively blocked by the first shading arrangement 20 and the lower portion of the light is selectively blocked by the second shading arrangement 30. Also, the user is able to fully fold either the first shading arrangement 20 or the second shading arrangement 30 as shown in FIGS. 3B and 3C, such that the multi-functional shading device is formed as a conventional salt type curtain or drapery type curtain respectively. As shown in FIG. 3D, the first and second shading arrangements 20, 30 are adapted to be folded up so that maximum light can pass through the window directly without any blockage by the multi-functional shading device.

It is worth to mention that the first operating means 22 and the second operating means are arranged to operate the first shading arrangement 20 and the second shading arrangement 30 individually so as to prevent the first and second shading arrangements 20, 30 from being interfered with each other. In other words, the first and second shading arrangements 20, 30 are adapted for selectively folding and unfolding individually so as to selectively block the intensity of the light.

Even the second shading arrangement 30 could be independently operated and detachably attached on the first shading arrangement 20, it is still worth to mention that lifting movement of the base member 21 will cause bound upper supporter 34 of the second shading arrangement to move thereby generating different light blocking effect as shown in FIG. 3A-FIG. 3D. Meanwhile, the translucent fabric 32 of the second shading arrangement 30 is light weight which is susceptible to be blow by the wind. According to the present invention, the multi-functional shading device further provides a wind-proof arrangement 50 adapted for restraining the shading device from swaying back and forth, especially prevent the light weight translucent fabric shading arrangement 30 from swaying disorderly.

The wind-proof arrangement 50 comprises a pair of sway-resisting guiding devices 51 extended downwardly from two side portions of the top transverse supporter 10 towards the base stabilizer 33 of the second shading arrangement for substantially restricting the first shading arrangement 20 and the second shading arrangement 30 from swaying back and forth under a windy circumstance.

According to the first preferred embodiment of the present invention, the height of each sway-resisting guiding device 51 should be slightly equal to the distance between the top transverse supporter 10 and the base stabilizer 33 of the second shading arrangement when translucent fabric 32 is substantially extended with an unfolded manner. What is more, each of the elongated sway-resisting guiding devices 51 is designed with a U-shaped cross section to be functioned as a resisting arm having two sidewalls 511 and a back wall 512 to define a receiving groove 513. Preferably, the width of the back wall 512 is larger than the width of slat 23 of the first shading arrangement and the width of fully folded Z-shaped translucent fabric 32 of the second shading arrangement 30. As a result, slats 23 of the first shading arrangement and Z-shaped folded translucent fabric 32 of the second shading arrangement are capable of smoothly sliding within the receiving groove 513 of the sway-resisting guiding device 51 without any undesirable friction. As a result, two elongated sway-resisting guiding devices 51, extended downwardly from the two side portions of the top transverse supporter 10 all the way to the base stabilizer 33 of the second shading arrangement 30, are capable of effectively blocking the swaying motion of the first and the second shading arrangement.

Moreover, the wind-proof arrangement 50 further comprises means for affixing the sway-resisting guiding device to the top traverse supporter 10 through side wall 511 or to surrounding window frames by back wall 512. By affixing the sway-resisting guiding device to the top traverse supporter 10, the user can combine the wind-proof arrangement 50 integrated with the window blinding system as a whole thus facilitate the wind-proof function.

Alternatively, the user can merely affix the sway-resisting guiding device to surrounding window frames for some convenience reasons. This is due to the fact that some times windows are disposed in a deep recess of the wall, the top traverse supporter 10 mounted with a pair of sway-resisting guiding devices will encounter some installing difficulties. Meanwhile, the length of sway-resisting guiding device 51 could be substantially shortened if it is affixed to the surrounding window frames as shown in FIG. 4B, 4C.

It is noted that sway-resisting guiding device are made of a variety of raw materials like stainless steel, lightweight aluminum alloy, decorative wood, plastic, as well as stiff paperboard. Commonly, if the user wishes combine the sway-resisting guiding device with the top traverse supporter 10, he or she may choose aesthetically appealing materials, such as stainless steel and aluminum alloy, to decorative the window blinding device. Otherwise, the user merely chooses cheaper guiding devices affixed on corresponding window frames.

The affixing means, as used herein, could be screws, rivet or even adhesive element. For instance, adhesive elements could be applied on the out layer of the U-shaped sway-resisting guiding device 51 and corresponding window frames to facilitate the affixing function.

Figure 4A:
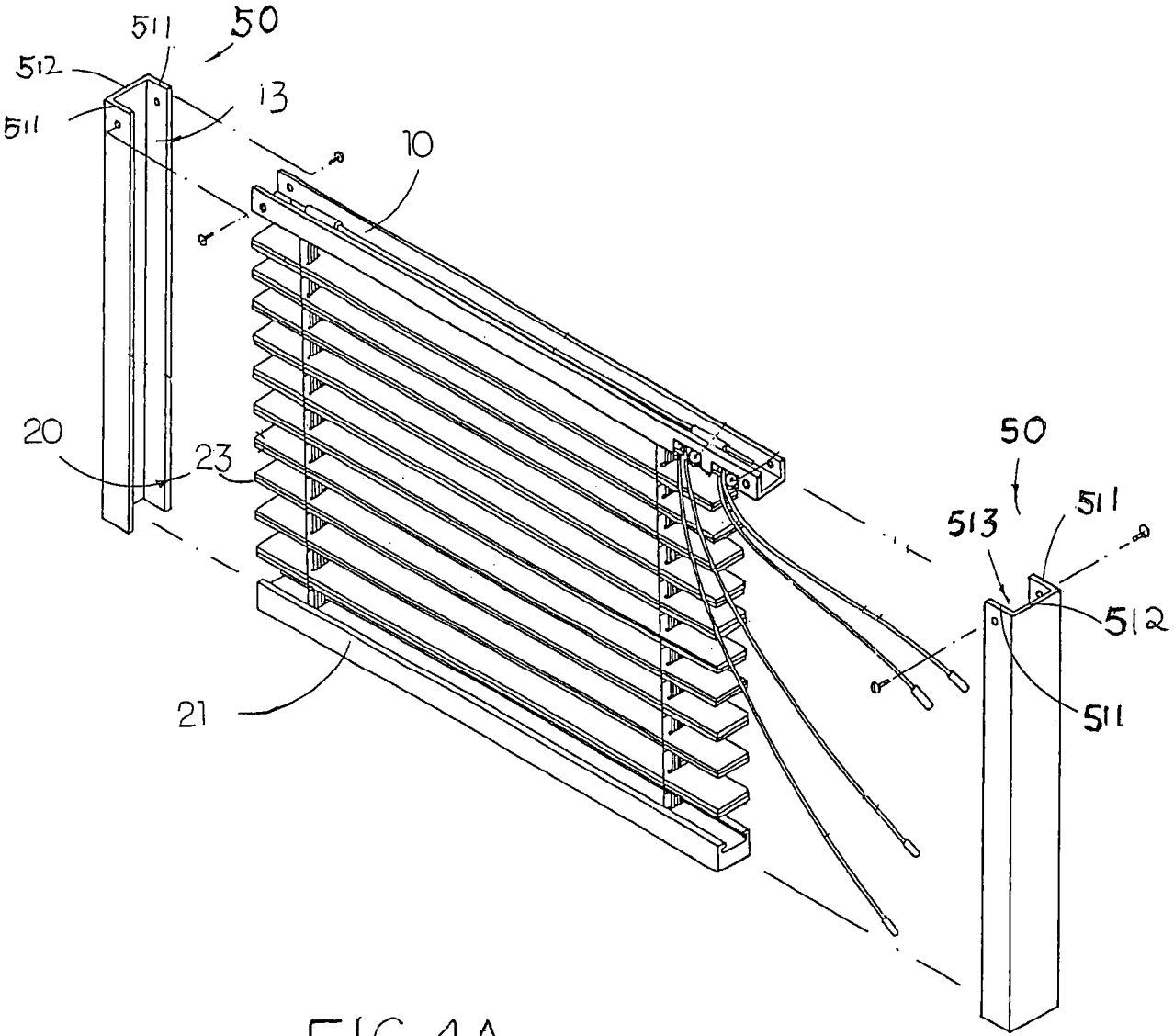
FIG. 4A illustrates a first mode of the wind-proof guiding devices according to the first preferred embodiment of the present invention.
Figure 4B:
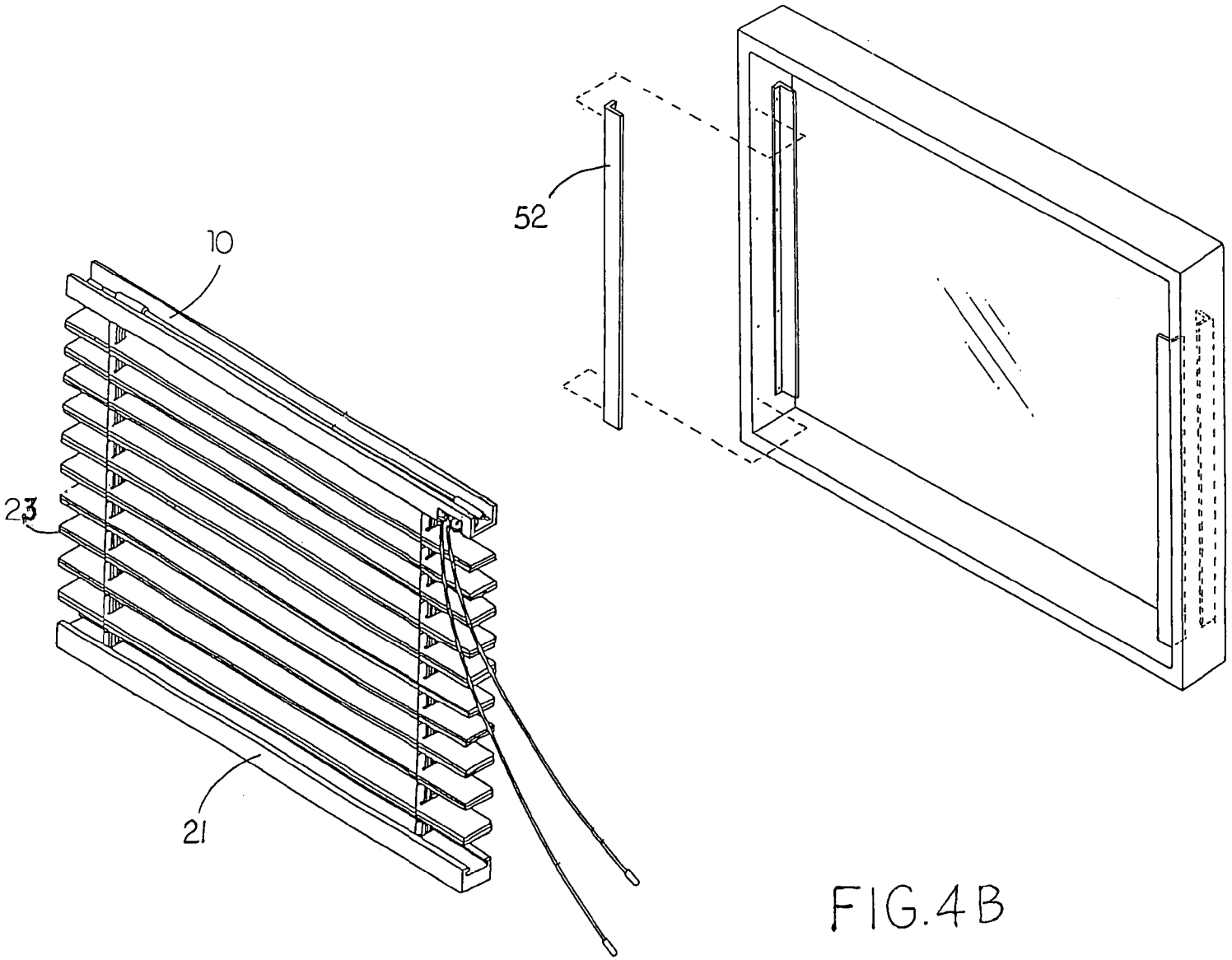
FIG. 4B illustrates a second alternative mode of the wind-proof guiding devices according to the first preferred embodiment of the present invention.
Figure 4C:
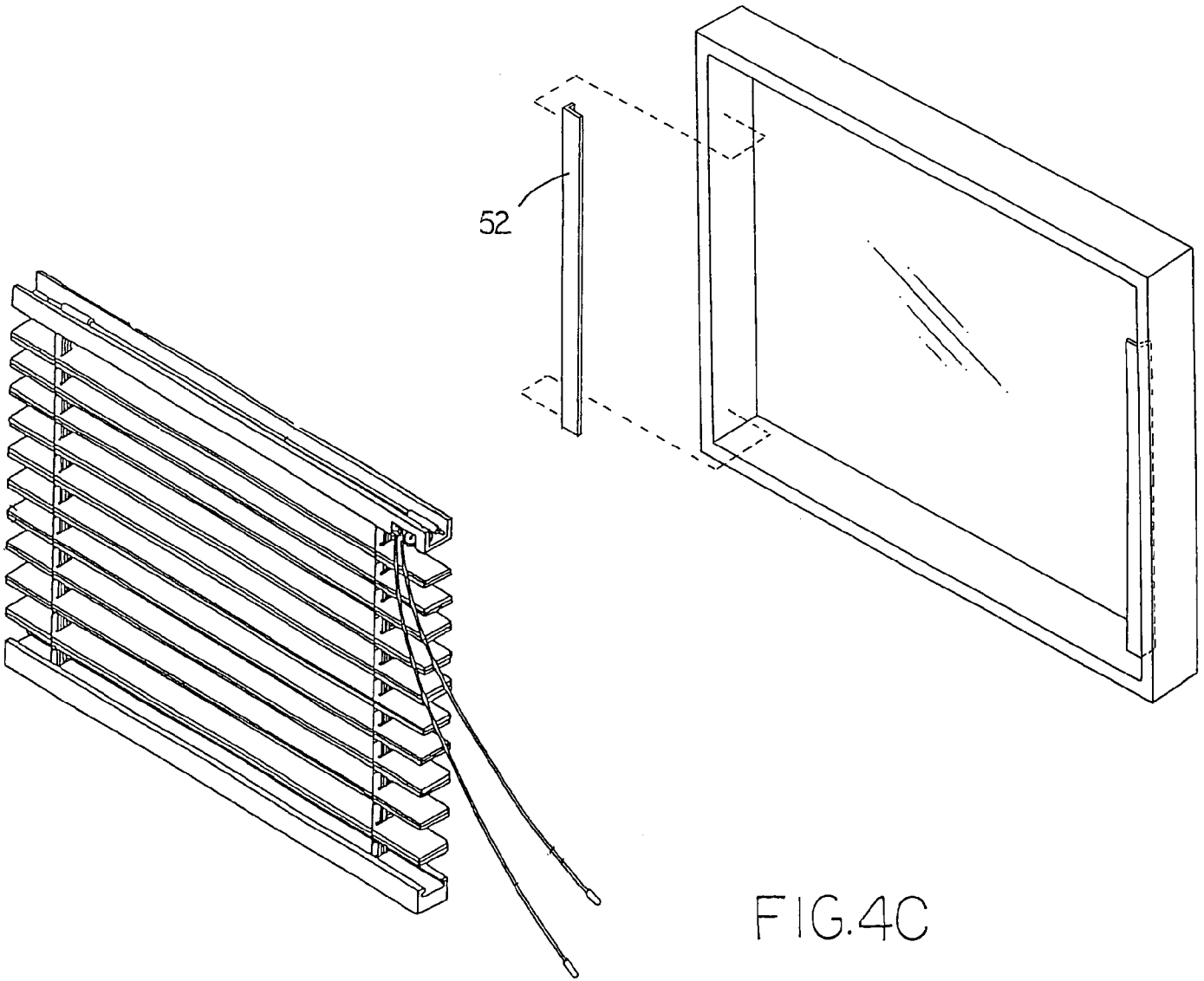
FIG. 4C illustrates a third alternative mode of the wind-proof guiding devices according to the first preferred embodiment of the present invention.

An alternative mode of sway-resisting guiding device is illustrated in FIG. 4B, wherein the each of the U-shaped sway-resisting guiding device 51 in the preferred embodiment is replaced by two L-shaped resisting arm 52. Since the width of U-shaped resisting arm has a fixed width, it is not suitable for some occasion. For example, if the user decides to replace the second shading arrangement 30 with an obscurer translucent fabric having strong light blocking capability, and the width of fully Z-shape folded obscurer translucent fabric is larger than the width of the U-shaped sway-resisting guiding device, the user either change mind or abandon the U-shaped sway-resisting guiding device. Here, the two L-shaped resisting arm 52 are just like longitudinally cleaving the U-shaped sway-resisting guiding device into two parts as shown in FIG. 4B. By the way, the two L-shaped resisting arm 52 are oppositely disposed, and affixed the surrounding window frames individually so as to define a receiving groove 522 for guiding the first shading arrangement and the second arrangement slide in a vertical moveable manner therein.

It is worth to mention when the window recess with respect to the surrounding wall is shallow, the user could selectively affix only one L-shaped resisting arm 52 to corresponding window frame as shown in FIG. 4C. As mentioned before, the user could choose one L-shaped resisting arm made of cheaper materials affixed to window frames to regulating the first shading arrangement 20 and the second shading arrangement 30 from swaying back and forth in a windy climate.

Figure 4D:
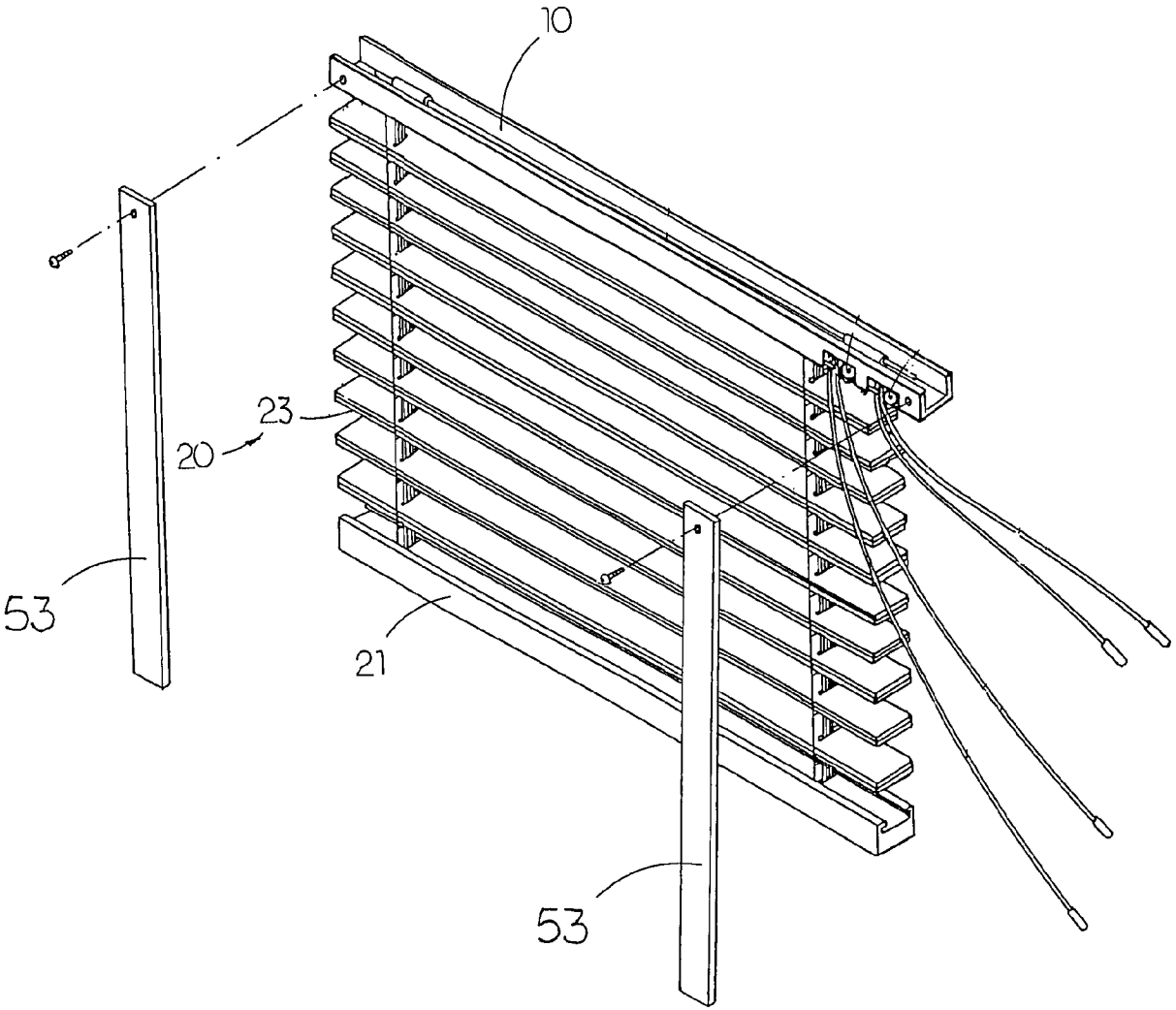
FIG. 4D illustrates a fourth alternative mode of the wind-proof guiding devices according to the first preferred embodiment of the present invention.

As shown in FIG. 4D, the user could merely use a pair of aesthetically appealing resisting arm 53 affixed to the top traverse supporter 10 to restrain the sway motion of the window blind system. This mode of resisting arm is easy to attach on the top traverse supporter 10 and made of comparatively cheaper materials. By the way, the resisting arm of in this mode could be made of simple shape, for example, two elongated wood arm.

Here, it is noted that the translucent fabric 32 of the second shading arrangement 30 is Z-shape folded to prevent the translucent fabric 32 being blow into middle portion protruded thereby causing an unsightly appearance. As mentioned before, the second operating means 31 comprises a second lift lock 311 rotatably mounted on the traverse supporter 10 and a pair of lift cords 312 upwardly extending to traversely extending through the traverse supporter 10, each of the lift cords 312 has a first end portion extended to the base stabilizer 33 and a second end portion extended out of the traverse supporter 10 via the second lift lock 311 for lifting up the base stabilizer 33 towards the upper supporter 34 and unlifting the base stabilizer 33 to drop downwardly away from the upper supporter 34, so as to fold and unfold the translucent fabric 32 respectively.

However, when the second shading arrangement 30 is independently operated and detachably attached on the first shading arrangement 20 as shown in FIG. 3. The lift cords 312 are not supposed to be mounted on the traverse supporter 10, instead, the lift cords 312 has two end portions, which are affixed to the upper supporter 34 and base stabilizer respectively. Accordingly, the lift cords 312 are designed to penetrate every Z-shaped folded translucent fabric 32 so as to enhance the folding and unfolding operations of the second shading arrangement 30 as shown in FIG. 3.

Figure 5A:
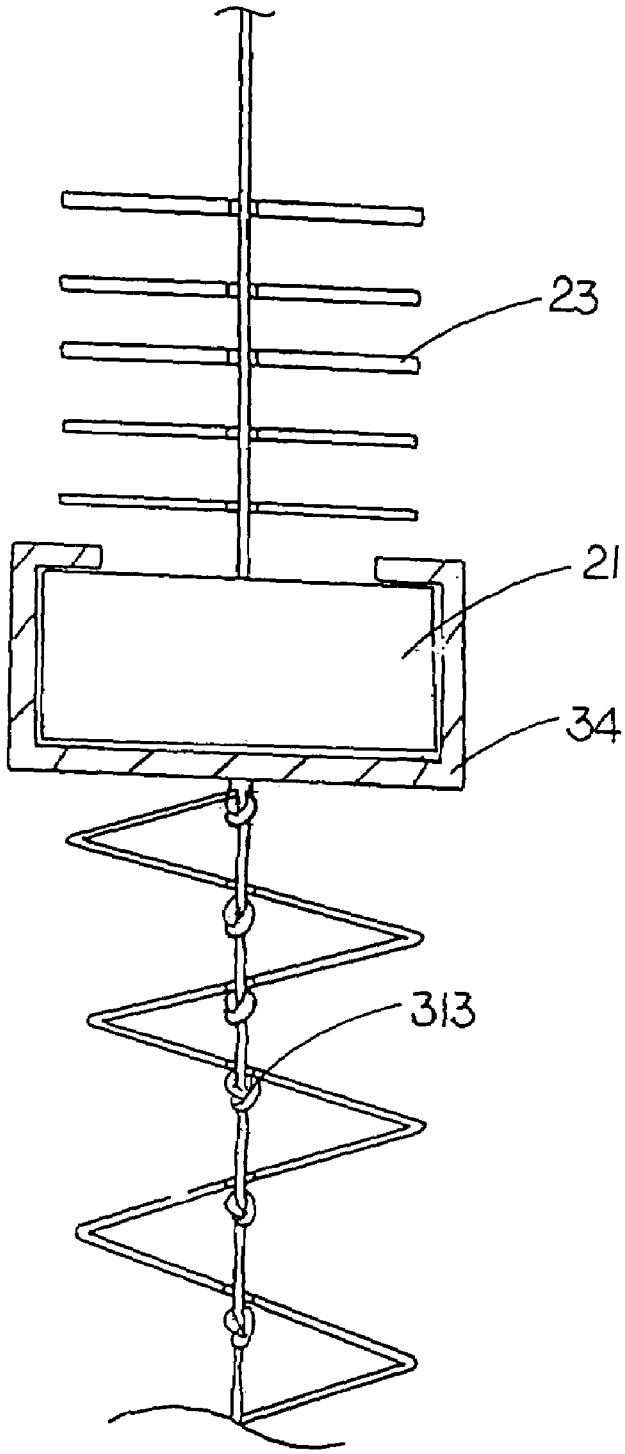
FIG. 5A-5B illustrates the spacedly knitted lift cords folded along with the second shading arrangement of the present invention.
Figure 5B:
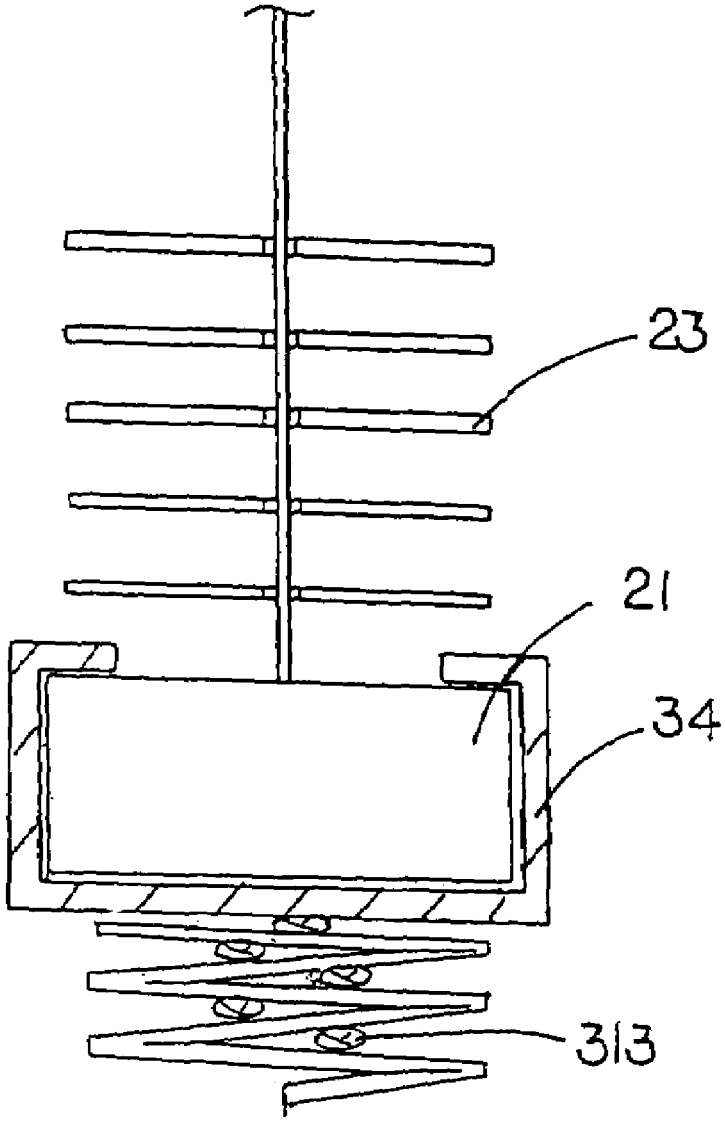

There is no doubt, that the lift cords 312 could facilitate the operation of the second shading arrangement. Commonly, the lift cords 312 has a predetermined distance to guarantee the second shading arrangement is fully unfolded to cover the window if the user favor the translucent blocking effect as shown in FIG. 3C. Nevertheless, when the second shading arrangement is disposed in a folded manner as shown in FIG. 3B, wherein the distance between the upper supporter 34 and the base stabilizer 33 is substantially shortened. As a result, at least a portion of lift cord 312 will unavoidably left abundant thus causing some unsightly appearance. According to the present invention, the lift cords 312 for folding and unfolding the second shading arrangement 30 are spacedly and evenly knitted to form a plurality of cord knot 313 so as to restrain the lift cords from fully retracting through the Z-shape folded translucent fabric 32 as shown in FIG. 5. Here, a plurality of through slots is defined on the translucent fabric 32 for receiving the lift cords 312. It is worth to mention that diameter of the cord knot 313 is slightly bigger than the diameter of through slots defined on the translucent fabric 32 so as to prevent the cord knot 313 from sliding trough the through slots.

Figure 6:
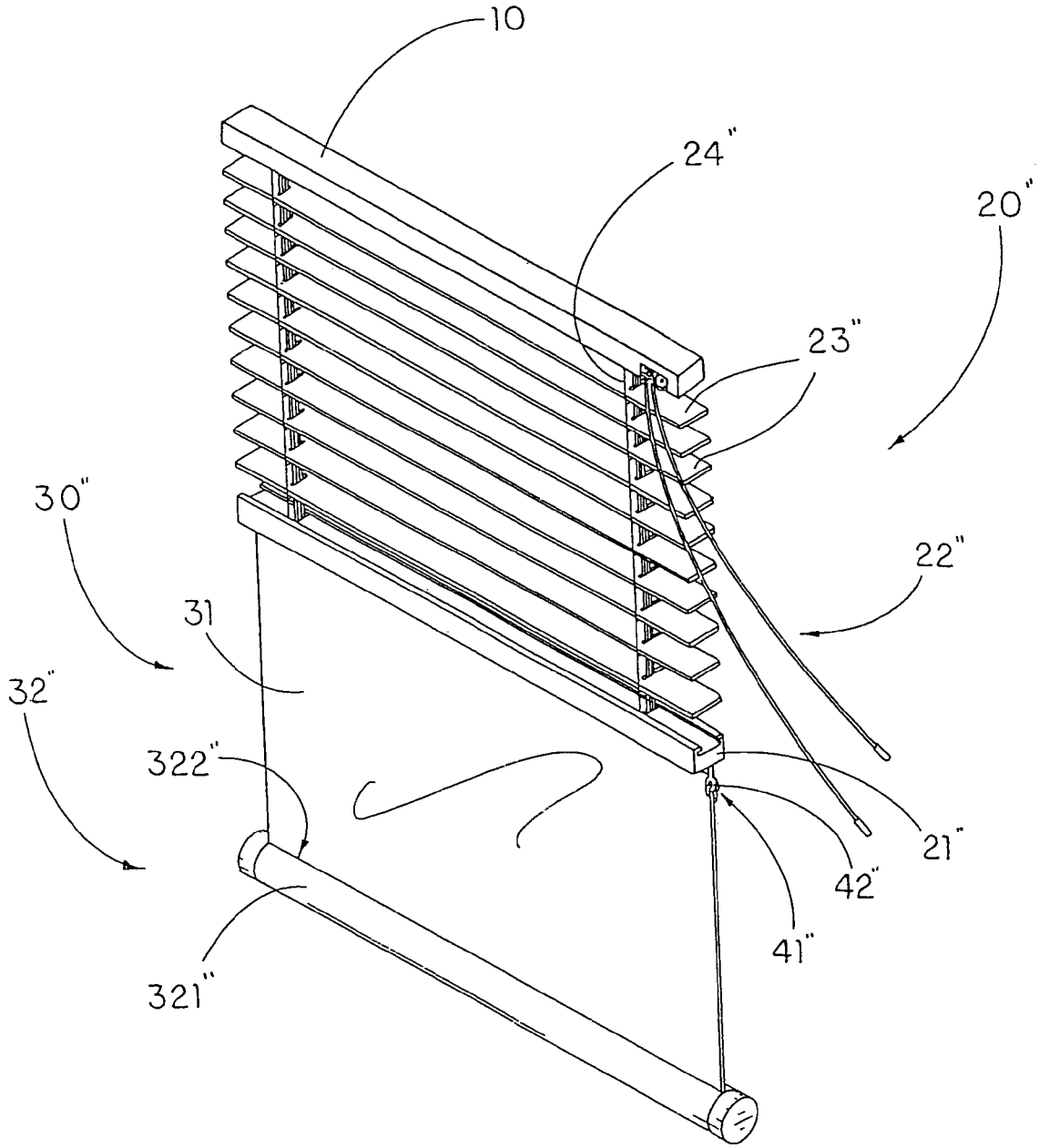
FIG. 6 is a perspective view of a multi-functional shading device according to a second preferred embodiment of the present invention.
Figure 7B:
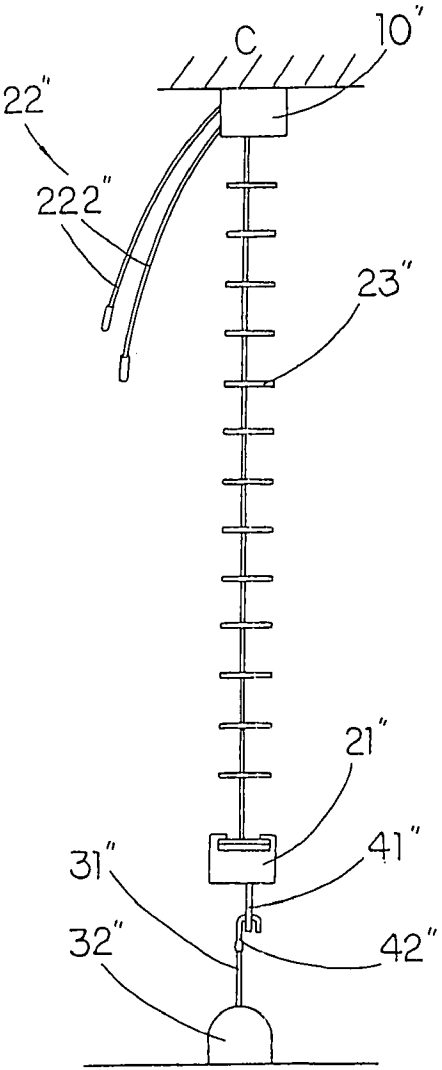
FIG. 7A to 7D are partially perspective views of the multi-functional shading device according to the above second preferred embodiment of the present invention.
Figure 7A:
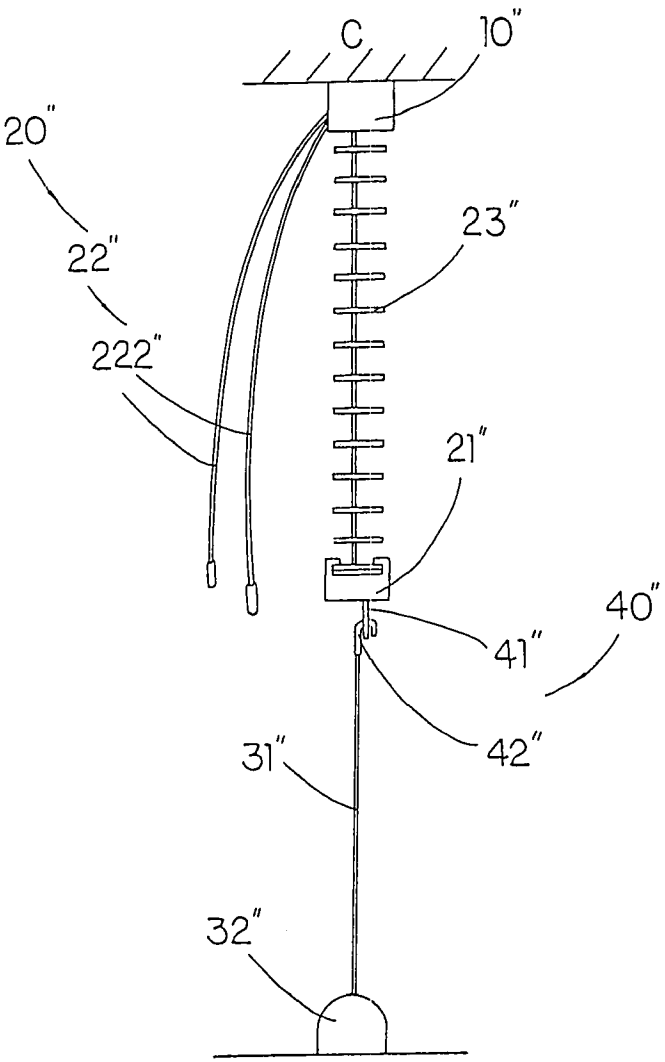
Figure 7D:
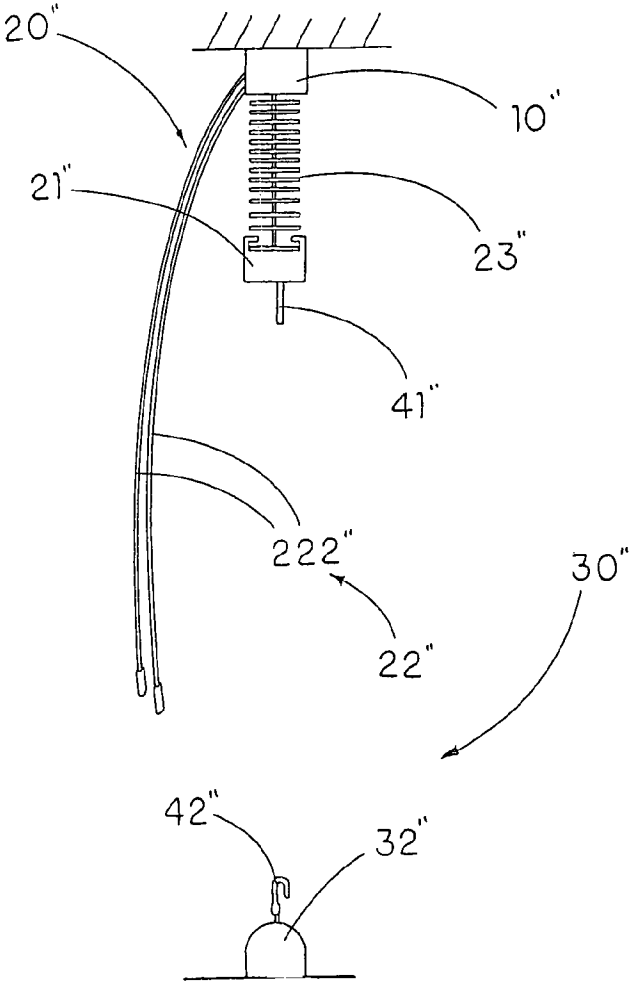
Figure 7C:
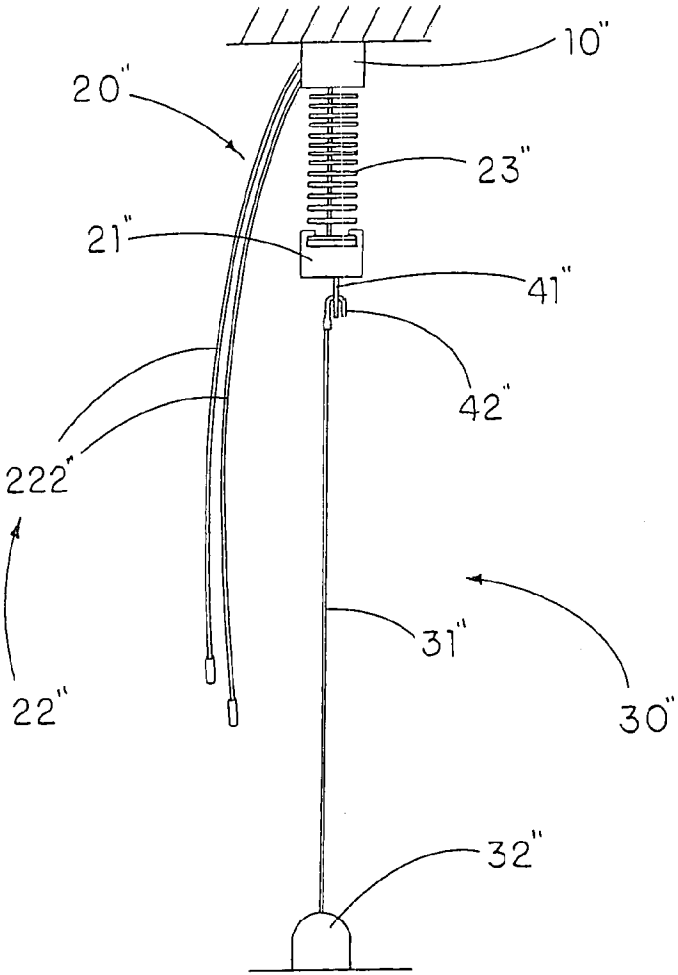

Referring to FIG. 6, a multi-functional shading device according to a second preferred embodiment of the present invention is illustrated, which is adapted for incorporating with an existing slat type curtain, wherein a first shading arrangement 20" is an existing slat type curtain comprising a base member 21", a first operating means 22", a plurality of slats 23" and a blind supporting system 24" as mentioned in the above first embodiment, wherein a second shading arrangement 30" is adapted for detachably attaching to the base member 21".

The second shading arrangement 30A comprises an upper supporter 34A, a base stabilizer 33A adapted for detachably attaching on a bottom beam D of the window, a translucent fabric 31A foldably extended between the upper supporter 34A and the base stabilizer 33A, and a second operating means for folding and unfolding the translucent fabric 31A.

As shown in FIG. 7, the connecting means 40" comprises a top connecting member 41" provided on a bottom surface of the base member 21" of the first shading arrangement 20" and a bottom connecting member 42" provided on a top edge of the translucent fabric 31" in such a manner that the top connecting member 41" is adapted for detachably connecting to the bottom connecting member 42" so as to detachably attach the second shading arrangement 30" to the first shading arrangement 20". Accordingly, the top connecting member 41" is a pair of engaging rings 411" affixed to two ends of the base member 21" of the first shading arrangement 20" and the bottom connecting member 42" is a pair of engaging hooks 421" affixed to two top edge ends of the translucent fabric 31" for hooking on the two engaging rings 411" respectively.

Figure 8:
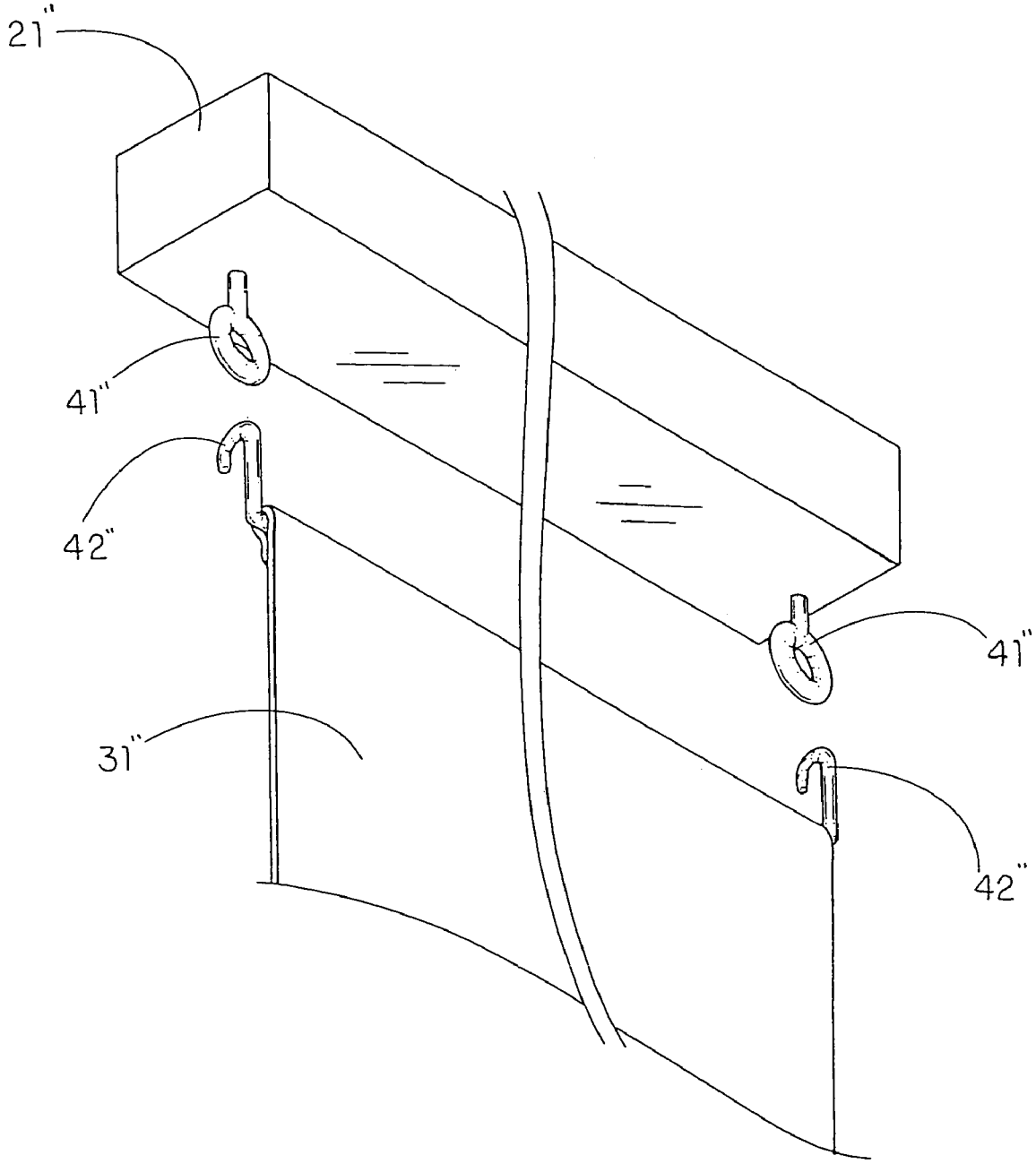
FIG. 8 illustrates an operation of the multi-functional shading device according to the above second preferred embodiment of the present invention.

For attaching the second shading arrangement 30" to the first shading arrangement 20', the translucent fabric 31" is pull out of to the base member 21". When folding up the translucent fabric 31", simply detach the translucent fabric 31" from the base member 21", and then the receiving device 321" will automatically roll up and receive the translucent fabric 31" in the receiving device 321", as shown in FIG. 8.

Figure 9:
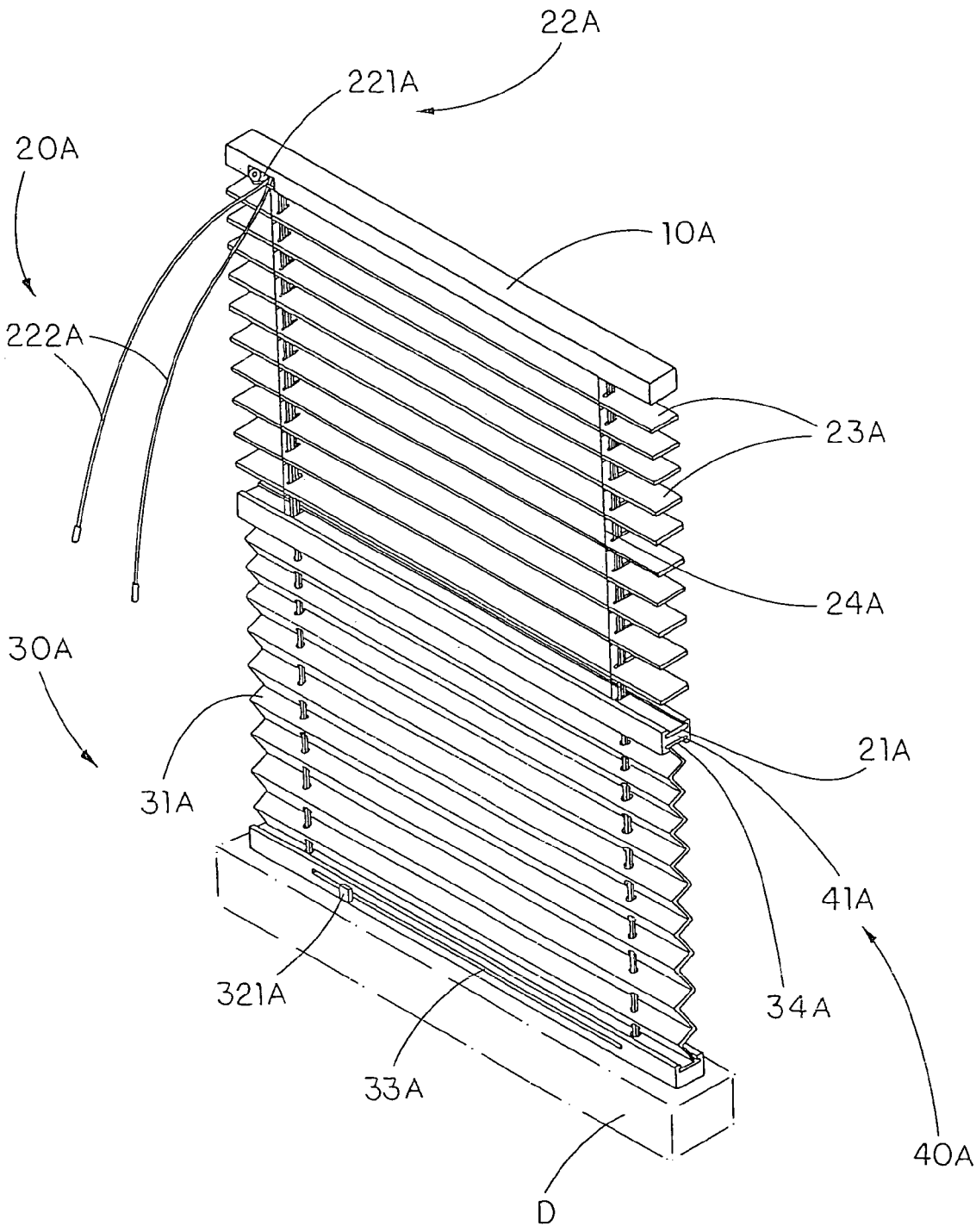
FIG. 9 is a perspective view of a multi-functional shading device according to a third preferred embodiment of the present invention.

Referring to FIG. 9, a third embodiment of the present invention illustrates an alternative mode of the above second embodiment, which is adapted for mounting on the existing slat type curtain.

As shown in FIG. 9, a first shading arrangement 20A is an existing slat type curtain comprises a base member 21A, a first operating means 22A, a plurality of slats 23A, and a blind supporting system 24A as mentioned above, wherein the second shading arrangement 30A is adapted for detachably mounting on the base member 21A of the first shading arrangement 20A.

The second shading arrangement 30A comprises an upper supporter 34A, a base stabilizer 33A adapted for detachably attaching on a bottom beam D of the window, a translucent fabric 31A foldably extended between the upper supporter 34A and the base stabilizer 33A, and a second operating means 32A for folding and unfolding the translucent fabric 31A.

Figure 10:
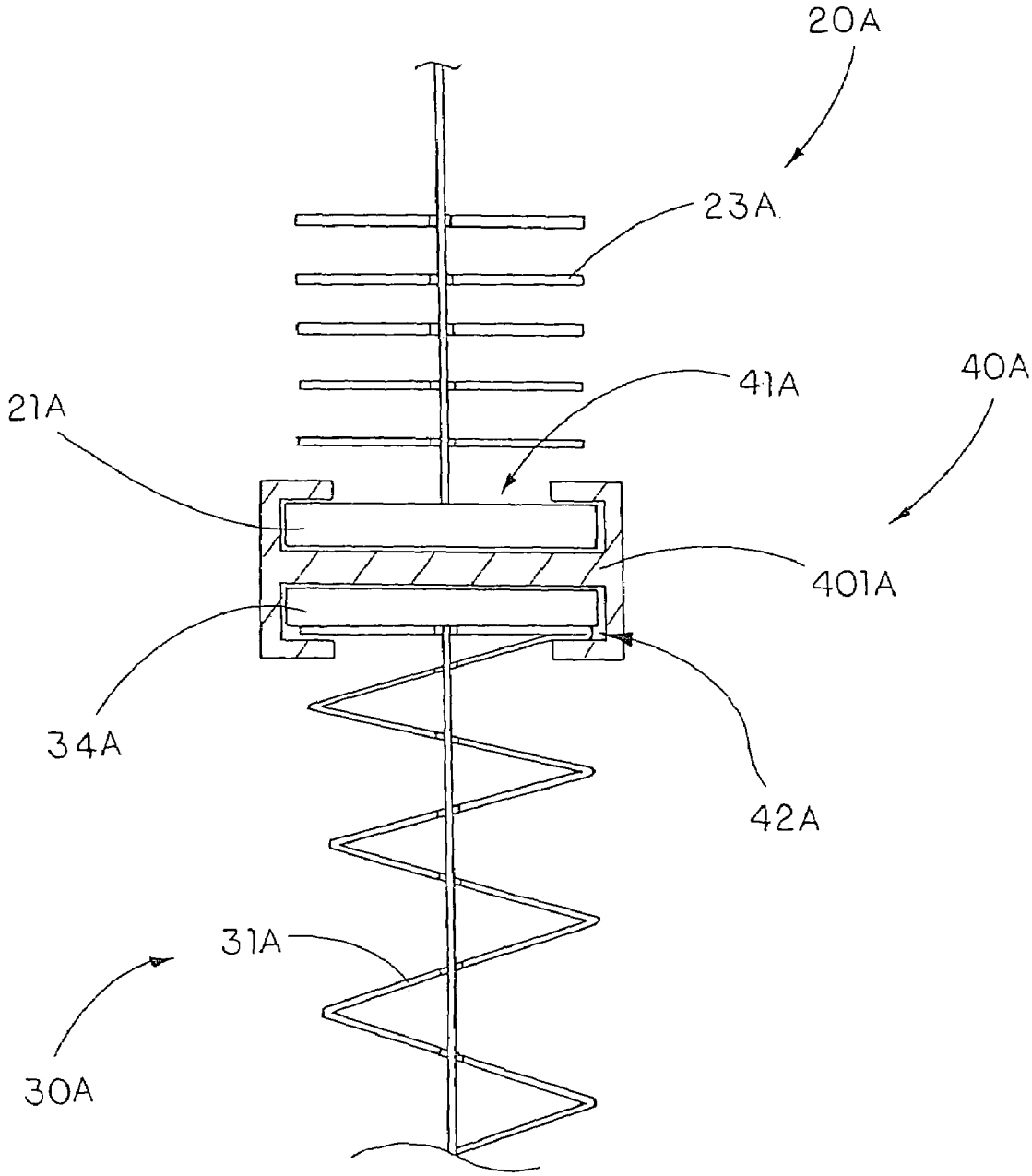
FIG. 10 is a partially side view of the multi-functional shading device according to the above third preferred embodiment of the present invention.

The connecting means 40A comprises a H-shaped connecting member 401A having a top mounting slot 41A and a bottom mounting slot 42A wherein the base member 21A of the first shading arrangement 20A is slidably inserted into the top mounting slot 41A and the upper supporter 34A of the second shading arrangement 30A is slidably inserted into the bottom mounting slot 42A, so as to securely connect the second shading arrangement 30A to the first shading arrangement 20A, as shown in FIG. 10.

Figure 11:
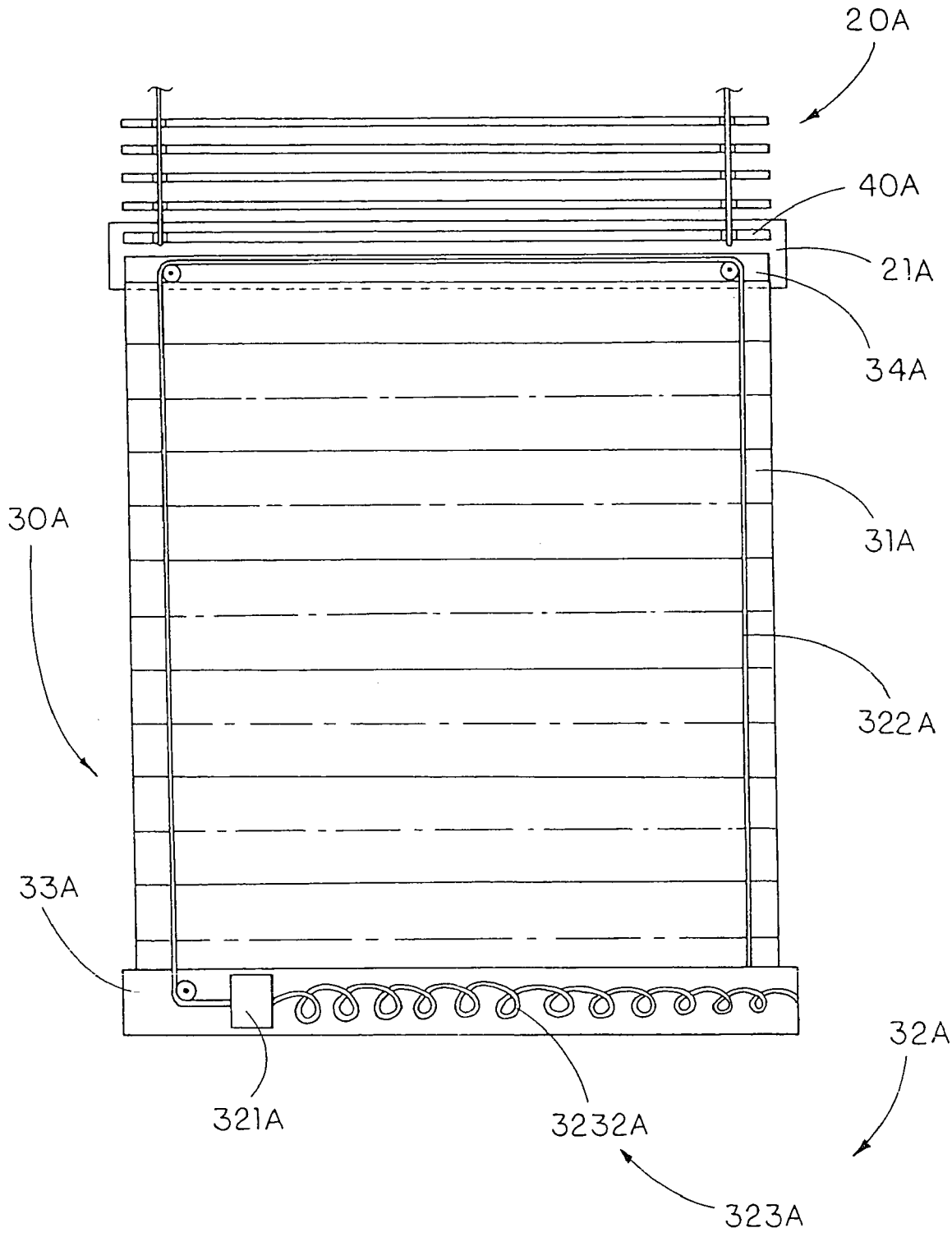
FIG. 11 is a partially sectional view of the multi-functional shading device according to the above third preferred embodiment of the present invention.

As shown in FIG. 11, the second operating means 32A comprises a lift locker 321A slidably mounted on the base stabilizer 33A, a lift cord 322A having a first end affixed to the base stabilizer 33A and a second end affixed to the lift locker 321A wherein the lift cord 322A is penetrating through two side portions of the translucent fabric 32A and extending along the upper supporter 34A, and a lift retaining device 323A for applying an urging force to the lift locker 321A so as to retain the lift locker 321A on the base stabilizer 33A in position. In which, the lift locker 321A is arranged to slide towards to the first end of the lift cord 322A to lift up the base stabilizer 33A so as to fold up the second shading arrangement 30A and is arranged to slide away from the first end of the lift cord 322A to lift up the base stabilizer 33A so as to fold up the second shading arrangement 30A and is arranged to slide away from the first end of the lift cord 322A to drop down the base stabilizer to unfold the second shading arrangement 30A.

The lift retaining device 323A comprises a compression spring 3232A mounted in the base stabilizer 33A and the base stabilizer has a side end. The compression spring 3232A has one end affixed to the side end of the base stabilizer 33A and another end affixed to the lift locker 321A. Accordingly, the compression spring 3232A will normally urge and retain the lift locker 321A towards to the first end of the lift cord 322A so as to fold up the second shading arrangement 30A.

Figure 12:
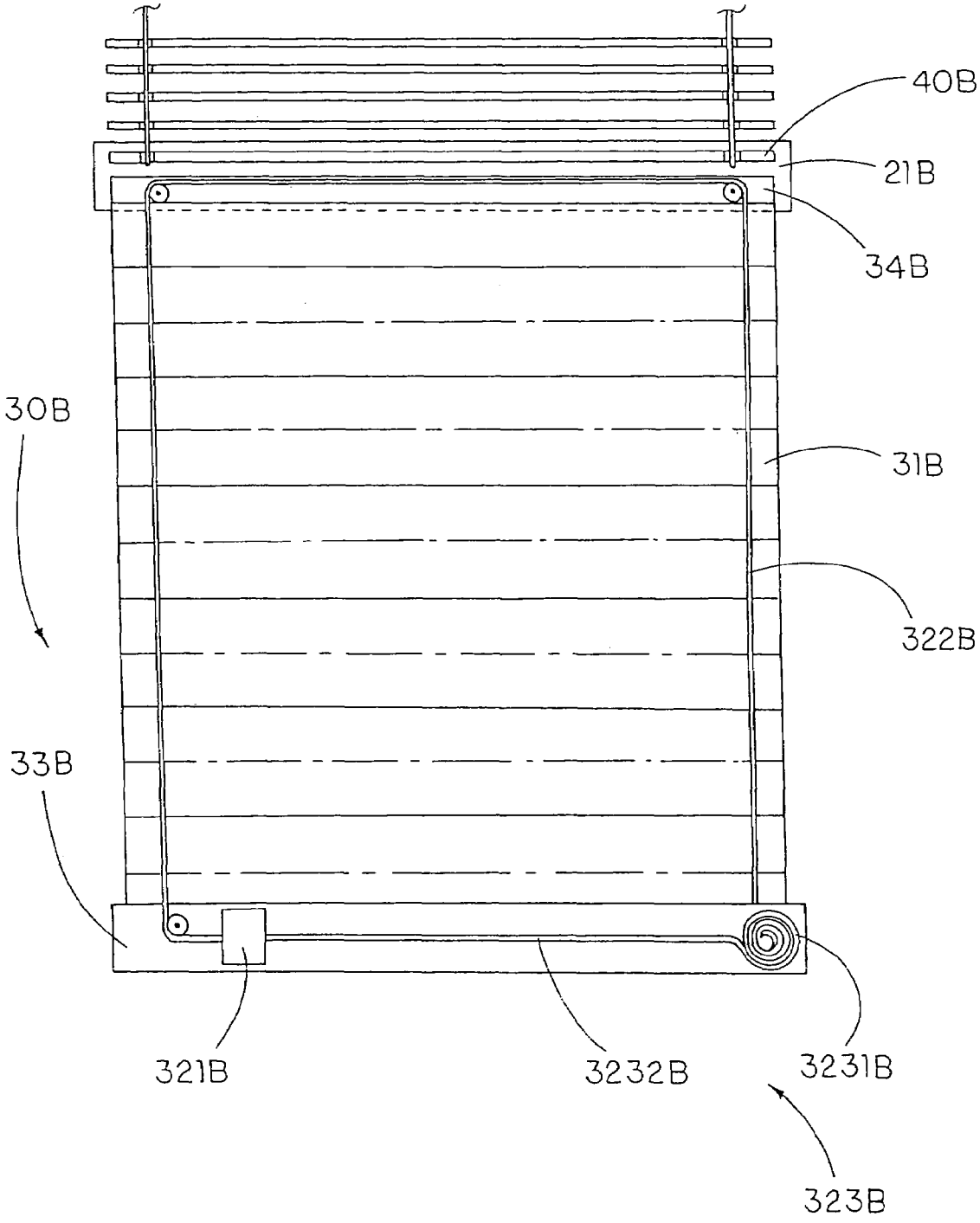
FIG. 12 illustrates an alternative mode of a lift retaining device of the multi-functional shading according to the fourth preferred embodiment of the present invention.

FIG. 12 illustrates an alternative mode of the lift retaining device 323B which comprises an auto-pulley system 3231B provided in the side end of the base stabilizer 33B wherein the auto-pulley 3231B having an automatic retractable extending cable 3232B is affixed to the lift locker 321B for applying the urging force to the lift locker 321B, so as to retain the second shading arrangement 30B in the folded position.

Figure 13:
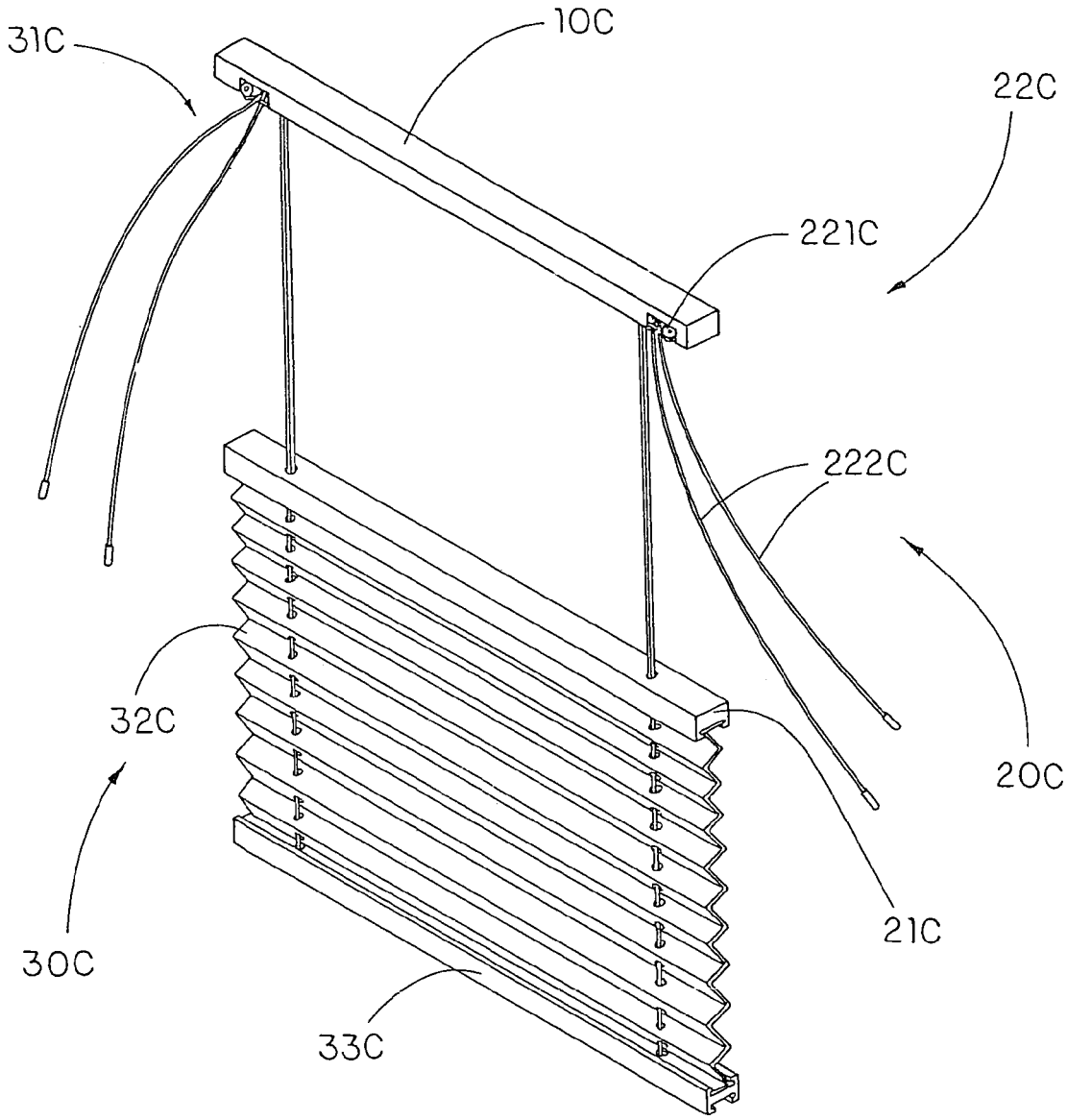
FIG. 13 is a perspective view of a multi-functional shading device according to a fourth preferred embodiment of the present invention.

Referring to FIG. 13, a multi-functional shading device according to a fourth embodiment of the present invention is illustrated, which basically is an alternative mode of the above first embodiment of the present invention. The first shading arrangement 20C comprises a base member 21C downwardly extended form the top traverse supporter 10C and a first operating means 22C for selectively lifting up the base member 21C towards the traverse supporter 10C and unlifting the base member 21C to drop downwardly away from the traverse supporter 10C.

The first operating means 22C comprises a first lift lock 221C rotatably mounted on the traverse supporter 10C and a pair of lift cords 222C each having a first end portion extended to the bottom member 21C. Each of the two lift cords 222C upwardly extends to penetrate through the slats 23 and then traversely extends through the traverse supporter 10C, wherein a second end portion of each of the lift cords 222C is extended out of the traverse supporter 10C via the first lift lock 221C to control the folding and unfolding of the first shading arrangement 20C. in other words, the first shading arrangement 20C is a slat type curtain without a plurality of slats mounted between the traverse supporter 10C and the base member 21C so as to let the light directly passing through the first shading arrangement 20C.

The second shading arrangement 30C as mentioned in the first embodiment, which is downwardly extended from the base member 21C of the first shading arrangement 20C, comprises a base stabilizer 33C, a translucent fabric 32C extended between the base member 21C of the first shading arrangement 20C and the base stabilizer 33C, and a second operating means 31C for lifting up and dropping down the base stabilizer 33C to fold up and unfold the second shading arrangement 30C respectively.

Figure 14:
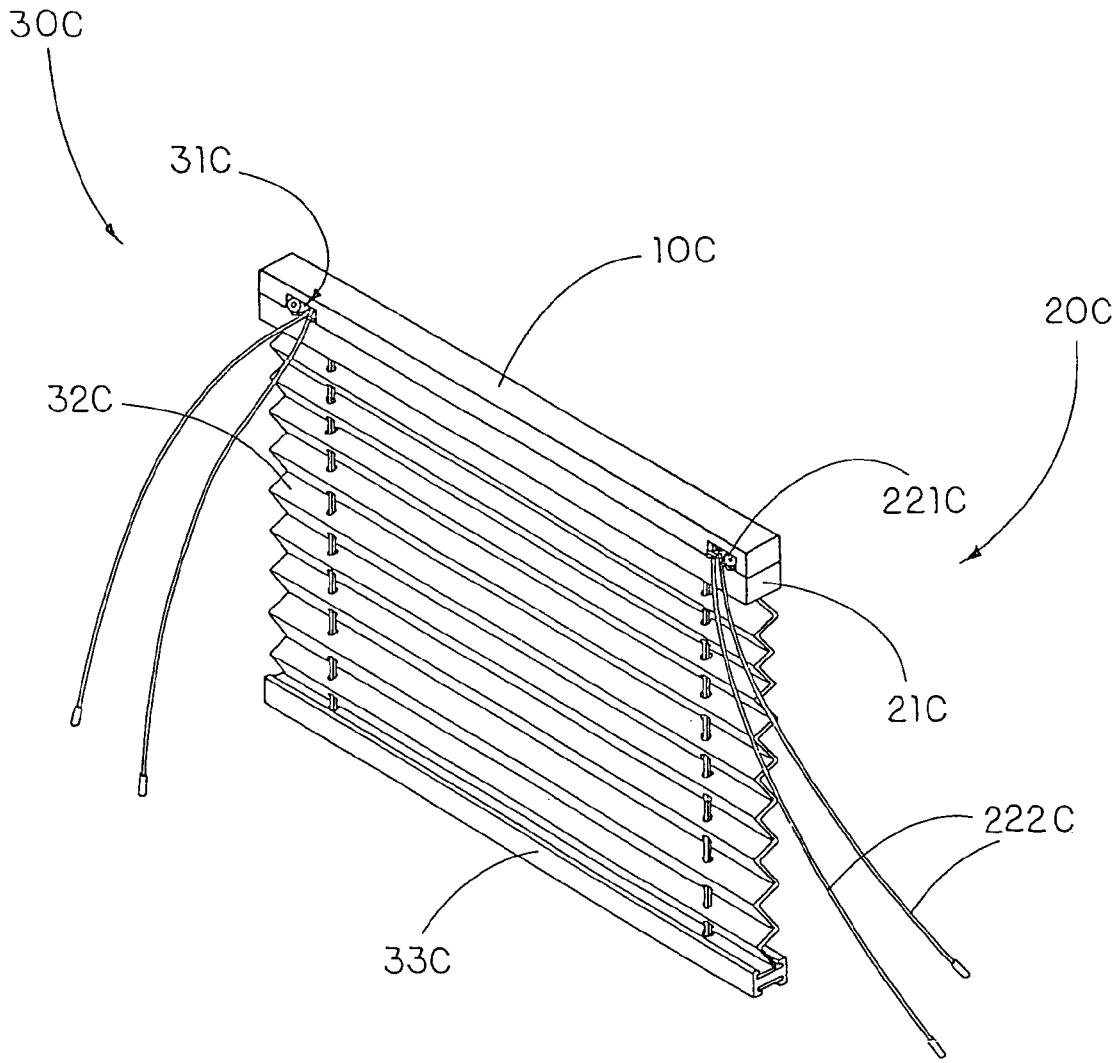
FIG. 14 is a perspective view of the multi-functional shading device according to the above fourth preferred embodiment of the present invention.

According to the fourth embodiment, the light can be directly pass through the first shading arrangement 20C of the multi-functional shading device and is partially blocked by the second shading arrangement 30C so that while using the multi-functional shading device, a room will obtain an adequate light intensity from the first shading arrangement 20C and people inside the room will not be irritated by the directed light since the light is blocked by the second shading arrangement 30C. Thus, the multi-functional shading device is adapted for selectively folding and unfolding the first and second shading arrangement 20C, 30C to adjustably block the light, as shown in FIG. 14.

Figure 15:
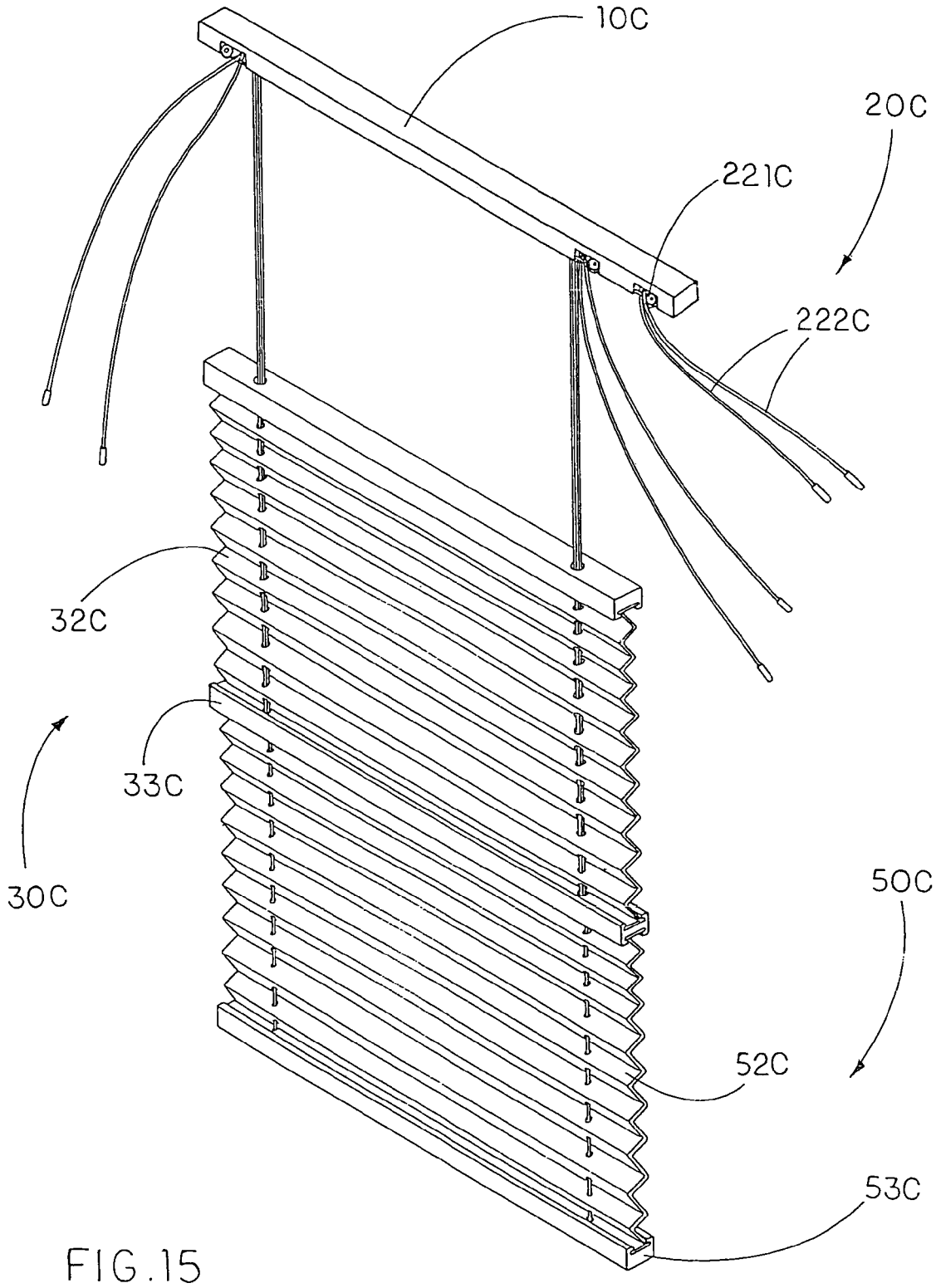
FIG. 15 illustrates an alternative mode of the multi-functional shading device according to the above fourth preferred embodiment of the present invention.

It is worth to mention that a third shading arrangement 50C as mentioned in the second embodiment is adapted for mounting on the second shading arrangement 30C for selectively blocking the light intensity wherein the third shading arrangement 50C comprises a supplementary translucent fabric 52C having different light blocking ability of the translucent fabric 32C of the second shading arrangement 30C for selectively blocking different intensities of light, as shown in FIG. 15.

While the foregoing description and drawings describe the preferred embodiments of the present invention, it should be appreciated that certain obvious modifications, variations, and substitutions may be made without departing from the spirit and scope of the present invention. For example, the first shading arrangement can be the drapery type curtain and the second shading arrangement can be the slat type curtain in order to selectively block the intensity of light by the upper section (the first shading arrangement) and the lower section (the second shading arrangement) of the multi-functional shading device. Also, an artistic printing can be printed on the translucent fabric so as to provide an aesthetically light effect when the light passes through the translucent fabric.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A multi-functional shading device, comprising:

a top traverse supporter;

a first shading arrangement downwardly extended form said top traverse supporter comprising a base member, a plurality of slats being horizontally and suspendedly supported between said traverse supporter and said base member, and a first operating means for selectively lifting up said base member towards said traverse supporter and unlifting said base member to drop downwardly away from said traverse supporter;

a second shading arrangement comprising an upper supporter, a base stabilizer, a translucent fabric, which is folded in a Z-shaped manner, downwardly extended from said base member to said base stabilizer, wherein said first and second shading arrangements having different light intensity blocking abilities are adapted for selectively blocking lights passing through from one side to another side of said shading arrangements respectively;

a mounting means for securely binding said first shading arrangement and said second shading arrangement so as to provide different light blocking effects, wherein said mounting means comprises an upper mounting member provided on said upper supporter to detachably attach on said base member so as to mount said second shading arrangement underneath said first shading arrangement; and a wind-proof arrangement which comprises a pair of sway-resisting guiding devices downwardly extended from two side portions of said top transverse supporter towards said base stabilizer of said second shading arrangement respectively for substantially restricting an unwanted lateral movement of each of said first and second arrangements from swaying back and forth;

wherein said upper mounting member has a longitudinal mounting slot formed on said upper supporter, wherein said base member is slidably engaged with mounting slot to mount said upper supporter to said base member so as to securely mount said second shading arrangement below said first shading arrangement;

wherein said second shading arrangement further comprises a second operating means which comprises a lift locker slidably mounted on said base stabilizer, a lift cord having a first end affixed to said base stabilizer and a second end affixed to said lift locker wherein said lift cord penetrates through two side portions of said translucent fabric and extends along said upper supporter, and a lift retaining device applying an urging force to said lift locker so as to retain said lift locker on said base stabilizer in position.

2. The multi-functional shading device, as recited in claim 1, wherein said lift locker is arranged to slide towards to said first end of said lift cord to lift up said base stabilizer so as to fold up said translucent fabric and is arranged to slide away from said first end of said lift cord to drop down said base stabilizer to unfold said second shading arrangement.

3. The multi-functional shading device, as recited in claim 2, wherein said lift retaining device comprises a compression spring mounted in said base stabilizer, wherein said compression spring has one end affixed to a side end of said base stabilizer and another end affixed to said lift locker, wherein said compression spring normally urges and retains said lift locker towards to said first end of said lift cord so as to fold up said translucent fabric.

4. The multi-functional shading device, as recited in claim 2, wherein said lift retaining device comprises an auto-pulley system provided in a side end of said base stabilizer wherein said auto-pulley system, which has an extending cable extending therefrom, is affixed to said lift locker for applying an urging force to said lift locker so as to retain said translucent fabric in said folded position.

5. A multi-functional shading device, comprising:

a top traverse supporter adapted for affixing to a top beam of a ceiling;

a first shading arrangement downwardly extended form said top traverse supporter comprising a base member, a plurality of slats being horizontally and suspendedly supported between said traverse supporter and said base member, and a first operating means for selectively lifting up said base member towards said traverse supporter and unlifting said base member to drop downwardly away from said traverse supporter;

a second shading arrangement comprising a base stabilizer, a translucent fabric, which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively; and a wind-proof arrangement comprising a pair of sway-resisting guiding devices downwardly extended from two side portions of said top transverse supporter towards said base stabilizer of said second shading arrangement respectively for substantially restricting an unwanted lateral movement of each of said first and second arrangements from swaying back and forth;

wherein each of said sway-resisting guiding devices having U-shaped cross section defines a receiving groove, wherein two side portions of said first and second shading arrangements are received in said receiving grooves of said two sway-resisting guiding devices respectively such that said first and second shading arrangements are allowed to slide along said receiving grooves in a vertically movable manner, wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along an upper supporter, and a lift retaining device applying an urging force to said lift locker so as to retain said lift locker on said base stabilizer in position.

6. A multi-functional shading device, comprising:

a top traverse supporter adapted for affixing to a top beam of a ceiling;

a first shading arrangement downwardly extended form said top traverse supporter comprising a base member, a plurality of slats being horizontally and suspendedly supported between said traverse supporter and said base member, and a first operating means for selectively lifting up said base member towards said traverse supporter and unlifting said base member to drop downwardly away from said traverse supporter;

a second shading arrangement comprising a base stabilizer, a translucent fabric which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively; and a wind-proof arrangement comprising a pair of sway-resisting guiding devices downwardly extended from two side portions of said top transverse supporter towards said base stabilizer of said second shading arrangement respectively for substantially restricting an unwanted lateral movement of each of said first and second arrangements from swaying back and forth;

wherein each of said sway-resisting guiding devices comprises two L-shaped resisting arms downwardly extended from two opposed sides of said top traverse supporter respectively to from a receiving groove between said two resisting arms for said respective side portions of said first and second shading arrangements receiving therein such that said first and second shading arrangements are allowed to slide along said receiving grooves in a vertically movable manner;

wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along an upper supporter, and a lift retaining device applying an urging force to said lift locker so as to retain said lift locker on said base stabilizer in position.

7. A multi-functional shading device, comprising:

a top traverse supporter adapted for affixing to a top beam of a ceiling;

a first shading arrangement downwardly extended form said top traverse supporter comprising a base member, a plurality of slats being horizontally and suspendedly supported between said traverse supporter and said base member, and a first operating means for selectively lifting up said base member towards said traverse supporter and unlifting said base member to drop downwardly away from said traverse supporter;

a second shading arrangement comprising a base stabilizer, a translucent fabric, which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively; and a wind-proof arrangement comprising a pair of sway-resisting guiding devices downwardly extended from two side portions of said top transverse supporter towards said base stabilizer of said second shading arrangement respectively for substantially restricting an unwanted lateral movement of each of said first and second arrangements from swaying back and forth;

wherein said sway-resisting guiding device comprises two elongated arm downwardly extended from a front side of said top traverse supporter for restricting said first shading arrangement and said second shading arrangement from swaying frontwardly;

wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along an upper supporter, and a lift retaining device applying an urging force to said lift locker so as to retain said lift locker on said base stabilizer in position.

* * * * *